US006530338B2

(12) United States Patent
Okumura et al.

(10) Patent No.: US 6,530,338 B2
(45) Date of Patent: Mar. 11, 2003

(54) FLAG SET

(75) Inventors: Takuji Okumura, Nagoya (JP); Takuya Okumura, 14-12 Sakae 2-chome, Naka-ku, Nagoya-shi, Aichi-ken, 460-0008 (JP)

(73) Assignees: Takuya Okumura, Nagoya (JP); Michiyo Okumura, Nagoya (JP)

( * ) Notice: Subject to any disclaimer, the term of this patent is extended or adjusted under 35 U.S.C. 154(b) by 0 days.

(21) Appl. No.: 09/809,866

(22) Filed: Mar. 15, 2001

(65) Prior Publication Data

US 2001/0022153 A1 Sep. 20, 2001

(30) Foreign Application Priority Data

Mar. 15, 2000 (JP) ..... 2000-071769

(51) Int. Cl.[7] ..... G09F 17/00

(52) U.S. Cl. ..... 116/173; 403/294; 40/606; 40/607

(58) Field of Search ..... 116/173, 63 R, 116/63 P; 403/294 XF, 259, 263, 303, 354, 381; 40/606 XF, 607 XF, 218, 610, 611; 24/457; 248/511, 539

(56) References Cited

U.S. PATENT DOCUMENTS 715,766 A * 12/1902 Dreman ..... 40/607
1,294,032 A * 2/1919 Bixby ..... 116/175
2,781,017 A * 2/1957 Fuller et al. ..... 116/63 R
2,948,257 A * 8/1960 Levey ..... 116/63 R
3,002,306 A * 10/1961 Ruff, Sr. ..... 40/107
3,706,297 A * 12/1972 Voorhees ..... 116/174
3,837,754 A * 9/1974 Malcik ..... 403/217
4,361,314 A * 11/1982 Ohlson ..... 256/65

FOREIGN PATENT DOCUMENTS

| | | |
|---|---|---|
| JP | 62-49193 | 3/1987 |
| JP | 3-33479 | 4/1991 |
| JP | 2597204 | 4/1999 |

* cited by examiner

*Primary Examiner*—Diego Gutierrez
*Assistant Examiner*—Tania C. Courson
(74) *Attorney, Agent, or Firm*—Orrick, Herrington & Sutcliffe LLP

(57) ABSTRACT

A flag set may comprise a pole (10) and a plurality of flag units **(20*a*, 20*b*) that can be attached to the pole (10) at different angles with respect to the pole (10). A support arm (30) may hold the top edges of the plurality of flag units (20*a*, 20*b*). An attachment part (40) is provided at the top of the pole (10) and may include attachment slits (47) and attachment grooves (48) that open upward so that the support arm (30) can be inserted from the top. A fastening part (50) anchors the support arm (30) to the attachment slits (47) and attachment grooves (48). The fastening part (50) is attached to the attachment part (40) after the support arm (30) is inserted into the attachment slits (47) and attachment grooves (48)** to lock these parts together.

20 Claims, 17 Drawing Sheets

RELATED ART

FLAG SET

BACKGROUND OF THE INVENTION

1. Technical Field

The present invention relates to a flag set and more particularly relates to a flag set that permits a variety of support arms to be attached to a pole.

2. Description of the Related Art

Several types of flag sets are known. For example, the most common type of flag set comprises a single flag unit attached to a pole. A support rod (support arm) is mounted perpendicular to the pole at the top of the pole. The support rod suspends the top edge of a flag or banner.

Another type of flag set is shown in FIG. 16 and includes two flag units 820*a*, 820*b* that are installed in opposite directions from a pole 810. A support arm 830 is formed in the shape of a straight rod and is mounted on top of the pole 810. The top edges of the two flag units 820*a*, 820*b* are suspended by the support arm 830. The two flag units 820*a* and 820*b* are connected by a plurality of loops 822 that are used to attach the flag unit(s) to the pole. A plurality of loops 826 is used to attach the flag unit to the support rod and are disposed at the top edge of each flag unit 820*a* and 820*b*. The two flag units 820*a* and 820*b* are attached to the pole 810 by the loops 822, which are used to attach the flag unit(s) to the pole. The two flag units 820*a* and 820*b* are also attached to the support arm 830 by the loops 826, which are used to attach the flag unit to the support rod.

Attachment part 840 is mounted on top of the pole 810 and as shown in more detail in FIG. 17. A penetrating hole 847 is bored through the attachment part 840 in a direction perpendicular to the pole 810. The cross section of the hole 847 is made to conform to the cross section of the support arm 830. In other words, the hole 847 has approximately the same area as the cross section of the support arm 830. A fastening part 850 is screwed onto the top of attachment part 840. A fastening hook 835*a* is first attached to one end of the support arm 830 and then a detachable fastening hook 835*b* is attached to the other end of the support arm 830. The loops 826 located at the tip of the flag units 820*a* and 820*b* (in other words, the loop farthest away from the pole) are hooked onto the attached hook 835*a* and the detachable hook 835*b*, as shown in FIG. 16. The flag units 820*a* and 820*b* are attached to the support arm 830 in this manner.

The support arm 830 is passed through the penetrating hole 847 with the detachable hook 835*b* removed from the support arm 830, as shown in FIG. 17. Then, the support arm 830 is fixed to the attachment part 840 and connected to the pole 810 by attaching the fastening part 850. After the support arm 830 is passed through the penetrating hole 847, the detachable hook 835*b* is re-attached to the other end of support arm 830. The support arm 830 is passed through the penetrating hole 847 in the pole 810 with the detachable hook 835*b* removed, because the penetrating hole 847 is made to match the cross section of the support arm 830. If the hole is too big, it would be difficult to firmly fix the support arm 830. Moreover, the support arm 830 can not pass through the penetrating hole 847 unless the detachable hook 835*b* is removed.

However, such a flag set presents several problems. First, the shape of support arm 830 is limited to a straight rod, because any other shape would be difficult to pass through hole 847. Further, one of the two hooks 835*a* or 835*b* must be made detachable from the support arm 830, as a non-permanently attached hook 835*b*. That is, both hooks can not be permanently fixed to the straight rod. Thus, if the support arm 830 is attached or detached from the pole 810, the detachable hook 835*b* must be removed from the support arm 830. Consequently, when the flag set is assembled or disassembled, the detachable hook 835*b* tends can be easily misplaced and lost.

SUMMARY OF THE INVENTION

It is, accordingly, one object of the present invention to teach improved flag sets.

In one aspect of the present teachings, flag sets are taught that provide a greater degree of freedom to design the structure of the support arm and preferably, a variety of support arms may be utilized with the flag set.

In another aspect of the present teachings, the support arm may be installed within the attachment part from above after the fastening part is removed from the pole. Then, as the fastening part is re-attached to the top of the pole, the support arm is fixed to the attachment part, and the support arm is connected to the top of the pole. For example, the support arm may be inserted from the topside of the pole (attachment part). Therefore, the hooks do not get in the way when the support arm is connected to the pole, even when all the hooks are attached ahead of time. The same advantage is realized when the support is disassembled from the pole. Consequently, in such a flag set, it is possible to permanently attach the hooks to the support arm, and the problem of misplacing the hooks can be avoided.

The hooks may be made separately from the support arm and then attached to the support arm. Alternatively, the hooks may be integral with the support arm. While the hooks can be removably attached to the support arm using a fastener or a suitable adhesive agent, the hooks are preferably permanently attached to the support arm.

Additionally, the support arm may be designed to be inserted into the pole (attachment part) from the topside. Therefore, the support arm can be connected to the pole even when it consists of more than three support rods that are arranged radially. Consequently, such a flag set can retain three or more flags on the pole at the same height. Further, the support arm is not required to be straight and, for example, a curved support arm may be utilized with the present flag sets. Thus, the present flag sets permit the use of a variety of support arms.

The attachment part is not required to be integrally formed on the pole. Thus, a separately formed attachment part may be installed on the pole. In addition, the fastening part may be attached to a separate part provided on the pole. Moreover, the attachment part may be inserted diagonally from above.

The present flag units include flags (banners) having a horizontal length greater than the vertical length and also include flags having much greater vertical length than the horizontal length. In addition, the support arm (in other words, the flag unit) may be connected to the pole in such a manner that it can rotate about the pole axis or it may be connected to the pole in a fixed position.

In another aspect of the present teachings, the attachment part may be formed at the top of the pole and may be capable of accepting two or more different types of support arms. Consequently, any desired flag unit (singular or plural) can be selected out of group of flag units. The support arm corresponding to the flag unit may be selected from a plurality of different support arms and inserted into the attachment part. Then, by attaching the fastening part to the top of the pole, the support arm is fixed to the attachment part, and the support arm is connected to the top of the pole. As a result, any desired flag unit selected from the flag unit group can be attached to the pole.

A plurality of flag units may be attached or only a single flag unit may be attached to the pole. Further, the support arm may hold the top edges of a plurality of flag units or only a single flag may be held. Additionally, a plurality of flag units may be selected or only a single flag unit may be selected. For example, a flag unit group may include 6 different flag units. Only one of the 6 flag units may be selected or two or more of the 6 flag units may be selected and attached to the pole. Further, there may be cases where only a single flag unit is used, or two joined flag units comprising two flag units are joined together. Naturally, 6 joined flag units comprising 6 flag units that are joined together may also be utilized.

In addition, one or more support arms may be selected from the group of support arms and one or more flag units selected from the group of said flag units. In addition, the size and/or shape of the flag unit can be selected from a group of flag units having different sizes and/or shapes. A plurality of flag units may be provided to allow a selection of various numbers of flag units. Various types of support arms may be provided to correspond to the number of flag units to be held by the pole. Naturally, various support arms also may be provided to correspond to various sizes and shapes of the flag units to be held by the pole.

In another aspect of the present teachings, each support rod (the part close to its base) is inserted into the attachment part from the top after the fastening part is removed from the pole. Then, as the fastening part is re-attached to the top of the pole and the base of each support rod is pressed together between a receiver portion and a contacting portion. The support rods are fixed to the attachment part in this manner and each support rod is coupled to the top of the pole. Additionally, each support rod is maintained at a prescribed angle with respect to the pole. Because the support rods are connected to the pole (attachment part) by insertion from the top, three or more support rods may be connected radially to the pole at the same height. Thus, this design provides additional freedom to design the support arms.

Herein, the part attached to the top of pole to hold the top edge of the flag unit (singular or plural) will be called the "support arm." When the support arm holds the top edges of a plurality of flag units attached in different directions with respect to the pole, each part of the support arm that holds the top edge of the flag unit in different directions with respect to the pole will be called the "support rod". Additionally, the portion of the support arm that extends from the pole (or proximally thereto) in the radial direction will sometimes be called the "support rod." In other words, even when the support arm includes a plurality of separate support rods (i.e. one support arm is divided into two or more separate support rods), it will be called the "support rod."

Additional objects, features and advantages of the present invention will be readily understood after reading the following detailed description together with the accompanying drawings and the claims.

BRIEF DESCRIPTION OF THE DRAWINGS

FIG. 4A shows a horizontal cross-sectional view. FIG. 4B shows a longitudinal sectional view taken along Line B—B in FIG. 4A. FIG. 4C is a longitudinal sectional view taken along Line C—C in FIG. 4A.

FIG. 15A shows a horizontal cross-sectional view. FIG. 15B shows a longitudinal sectional view.

DETAILED EXPLANATION OF THE INVENTION

Each of the additional features and constructions disclosed above and below may be utilized separately or in conjunction with other features and constructions to provide improved flag sets. Detailed representative examples of the present teachings, which examples utilize many of these additional features and constructions in conjunction, will now be described in detail with reference to the accompanying drawings. This detailed description is merely intended to teach a person of skill in the art further details for practicing preferred aspects of the present teachings and is not intended to limit the scope of the invention. Only the claims define the scope of the claimed invention. Therefore, combinations of features and constructions disclosed in the following detail description may not be necessary to practice the invention in the broadest sense, and are instead taught merely to particularly describe some representative examples of the invention. In addition, various combinations of the present teachings may be made, even though not specifically enumerated, in order to provide additional embodiments of the present teachings.

First Representative Embodiment

Figure 1:
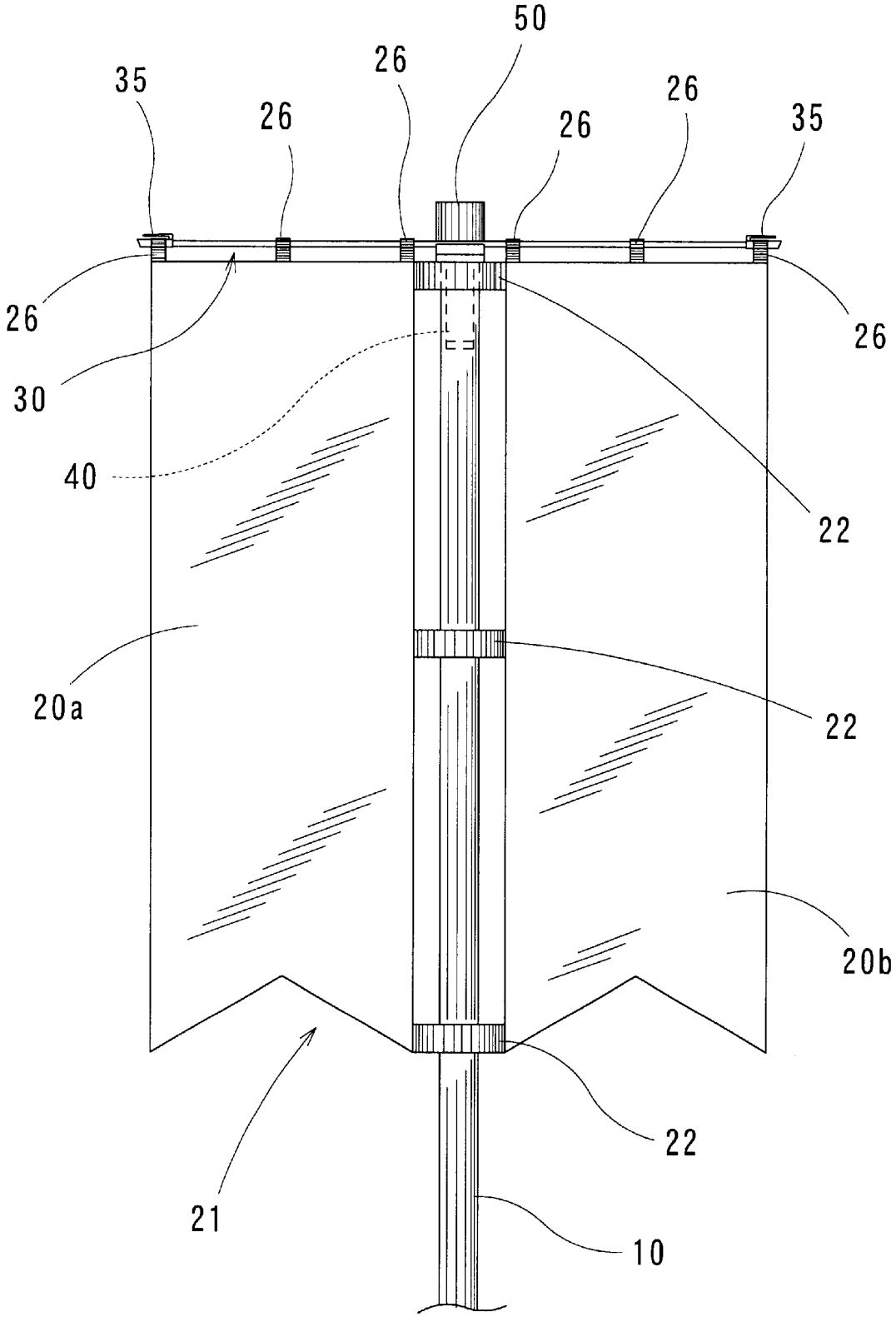
FIG. 1 is a plan view of a first representative flag set.

As shown in FIG. 1 through FIG. 4C, the first representative flag set may include, for example, a pole 10, two sheets of flag units 20*a*, 20*b* joint flag unit 21), support arm 30, attachment part 40, and a fastening part 50, as shown in FIG. 1. This flag set is designed to be assembled and disassembled by the user. The pole 10 may be formed from a plurality of pipes so that it can be extended or collapsed.

In other words, the degree of extension of each pipe can be adjusted, so that the overall length of the pole 10 can be adjusted.

Figure 3:
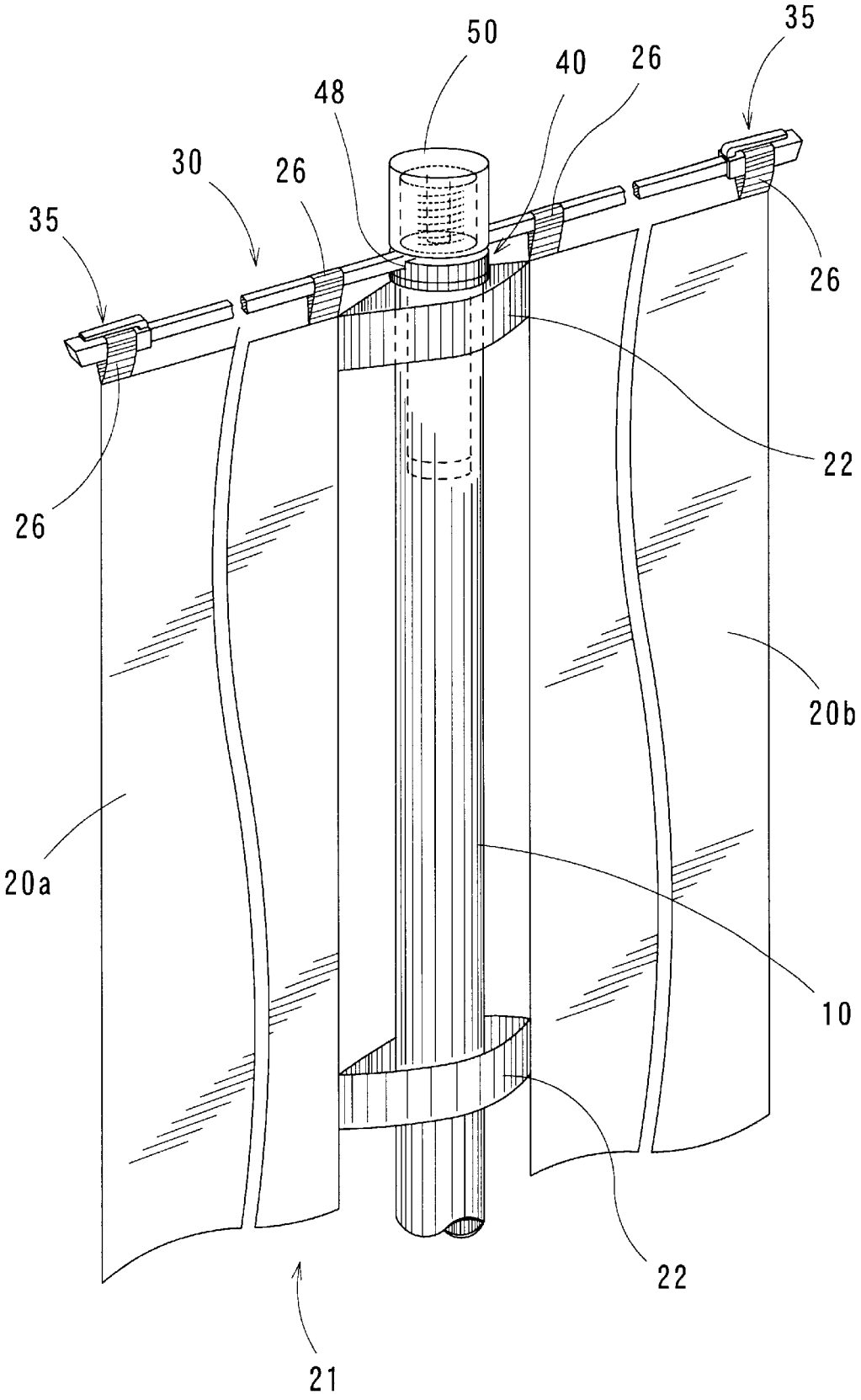
FIG. 3 shows an oblique view of certain portions of the first representative embodiment in an assembled state.
Figure 4A:
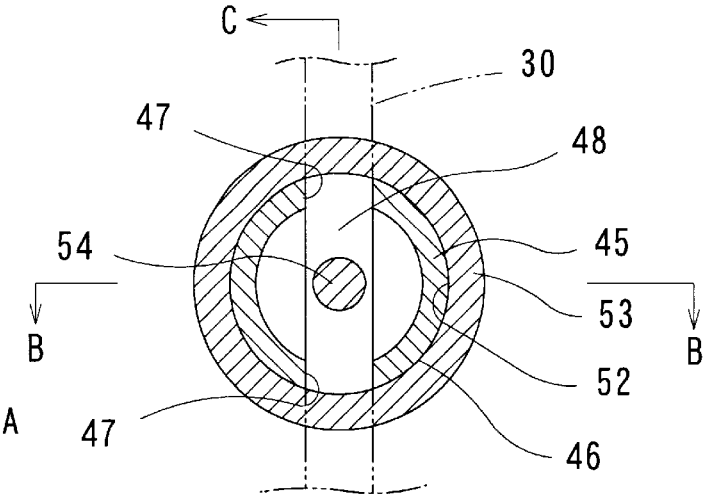
FIG. 4A through FIG. 4C show cross-sectional views of certain portions of the first representative embodiment. In particular.
Figure 4B:
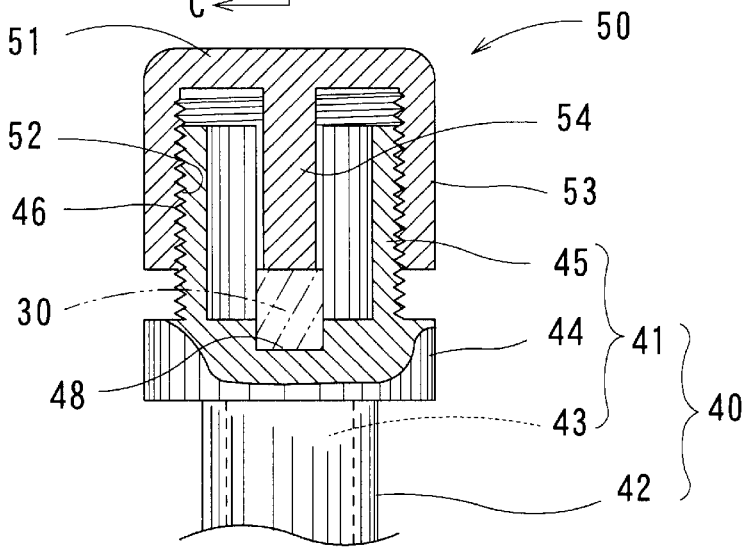
Figure 4C:
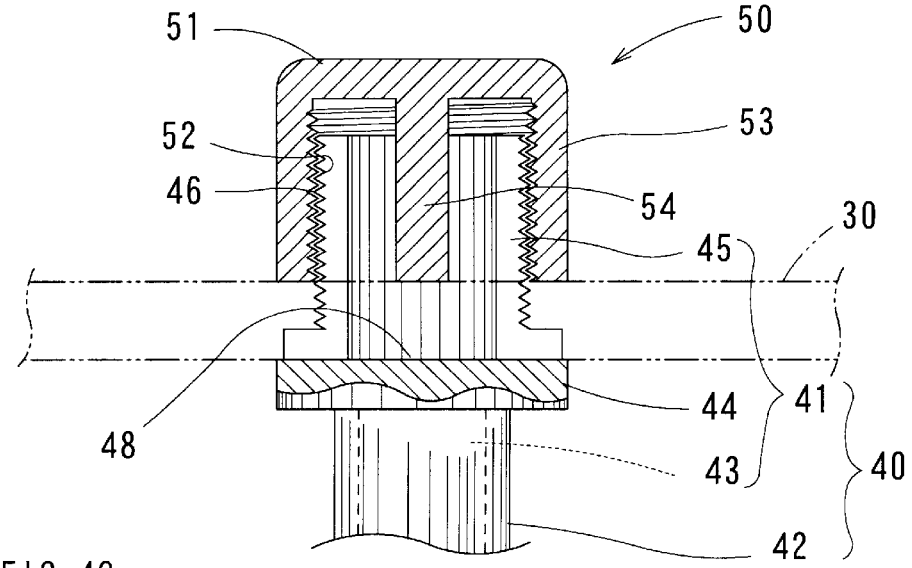

The two flag units 20*a* and 20*b* are made of a cloth forming a sash and may extend in longitudinal direction (long rectangular shape), as shown in FIG. 1 and FIG. 3. Such flag units are also known as banners. Between the two sheets of flag units 20*a* and 20*b*, a plurality of loops 22, which are used for attaching the flag unit(s) to the pole, are provided in the vertical direction. In other words, two sheets of flag units 20*a* and 20*b* (their inside edges) are connected by a plurality of loops 22 to form a joint flag unit 21. A plurality of loops 26 may be used to attach the flag unit(s) to the support rod(s) and may be provided at the top edges of each flag unit 20*a* and 20*b*. The loops 22 and the loops 26 may be made of a belt shaped cloth. Each flag unit 20*a* and 20*b* is attached to the pole 10 by the loops 22 and each flag unit 20*a* and 20*b* is also attached to the support arm 30 by the loops 26.

Figure 2:
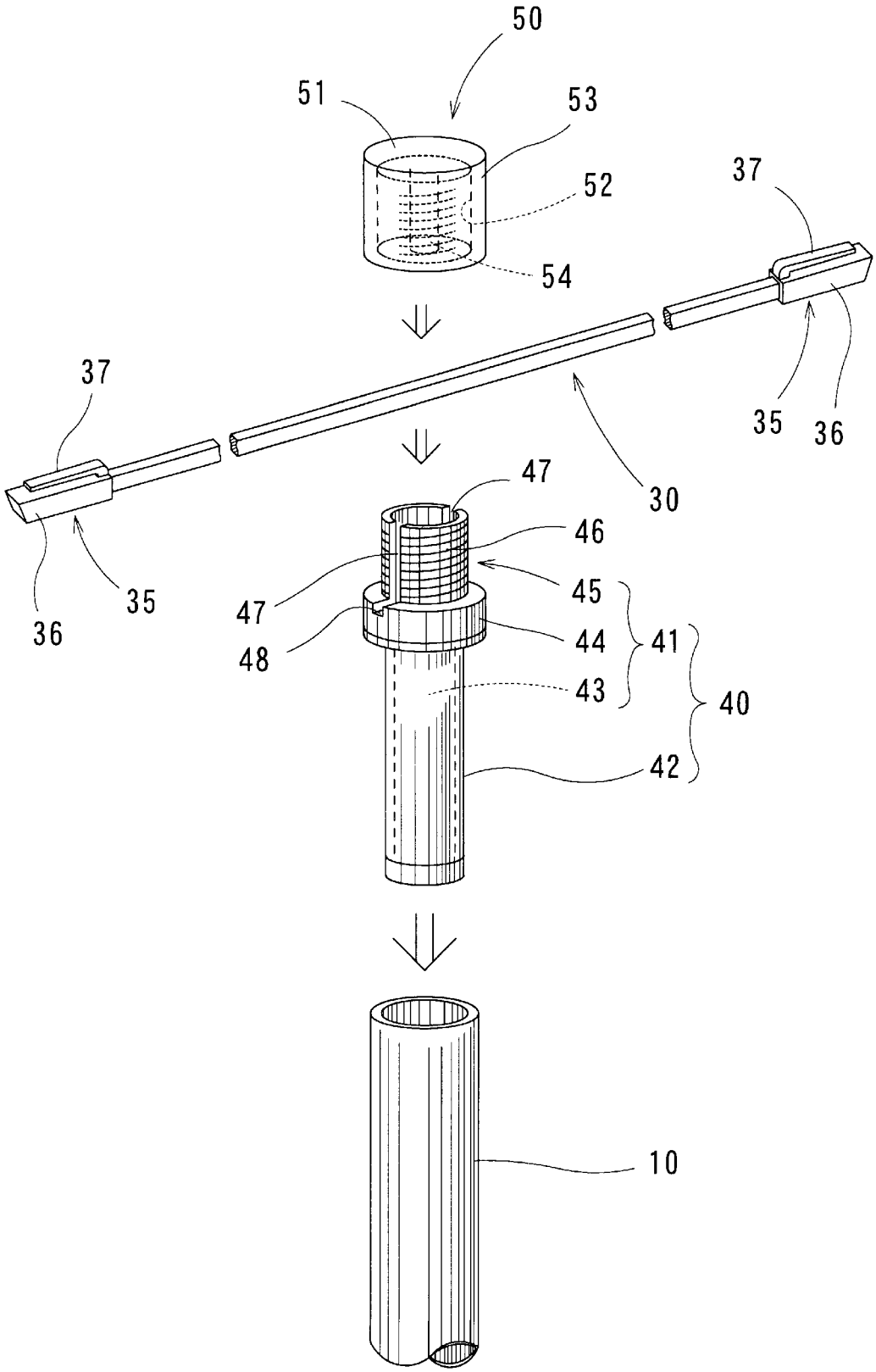
FIG. 2 shows an oblique view of certain portions of the first representative embodiment in a disassembled state.

The support arm 30 may be straight rod as shown in FIG. 2. In addition or in the alternative, the support arm 30 also can comprise two support rods connected at a 180° interval. The support arm 30 may have a rectangular cross section and hooks 35 are attached to both ends of the support arm 30. The hooks 35 may be preferably permanently attached to the support arm 30.

The hooks 35 may include an attachment part 36, hook part 37, and a stopper (not shown). An attachment hole (not shown) may be provided in the attachment part 36, so that the support arm 30 can be inserted into the attachment hole. The hook 35 may be frictionally attached to the support arm 30 between the attachment hole and the support arm 30 or may be integrally formed. The hook part 37 preferably extends from its base (the edge closest to the pole 10) to the tip (opposite edge) along the top of the attachment part 36. The tip of the hook part 37 extends close to the attachment part 36. The stopper forms a protrusion located slightly toward the base from the tip of the hook part 37 on top of the attachment part 36.

The attachment part 40 is preferably attached to the top of the pole 10 and may include a main unit 41 and an outer tube 42. The main unit 41 further includes a base axis 43 that may be mounted inside the outer tube 42 in such a manner that it can rotate (slide) about the axis. The outer tube 42 is inserted tightly inside the tubular pole 10 (rotation about the axis is restricted) forming a firm connection. However, the base axis 43 and its upper parts are free to rotate about the axis of the pole.

A flange 44 may be formed on the upper part of the base axis 43, and a connecting part 45 may be formed on the upper part of the flange 44. The connecting part 45 may have a cylindrical shape, and a male thread 46 is disposed on its outer periphery.

Slits 47 are vertically formed in the connecting part 45. That is, the slits 47 extend along the longitudinal axis of pole 10 and open to the top edge of attachment part 40. In this embodiment, two slits 47 are formed opposite to each other on the cylindrical shaped connecting part 45 (i.e. in diametrically opposite positions from the axis centerline.)

Each slit 47 extends from the top edge of the connecting part 45 to the upper part of the flange 44. A straight groove 48 is preferably formed on the upper part of the flange 44 passing through its center line, corresponding to the slit 47, as shown in FIG. 2 and FIGS. 4A through 4C. The width of the groove 48 and the width of the slits 47 preferably correspond to the width of the cross section of the support arm 30. The depth of each slit 47 is made sufficiently deeper than the height of the cross section of the support arm 30. The pair of slits 47 and the groove 48 form an upward opening in such a manner that the support arm 30 can be inserted from the top. The slit 47 is not required to reach the flange 44 and, moreover, the grooves 48 in the flange 44 are optional in this embodiment.

The connecting part 45 may be formed in the shape of a column instead of a cylinder. A groove shaped attachment part also may be formed with an upward opening on the column shaped connecting part 45. In this case, a contacting stud 54 (described below) is not required for fastening part 50. This is also true for the other representative embodiments of the present teachings.

The fastening part 50 may be attached to the attachment part 40 as shown in FIG. 2. The fastening part 50 preferably has a cylindrical shape part 53 and top plate 51 closes the top. The inner surface of the cylindrical part preferably has a female thread 52 formed therein. The female thread 52 is formed to mate with the male thread 46 formed on the attachment part 40.

A contact stud 54 may be provided inside the fastening part 50 as shown in FIG. 2 and FIGS. 4A through 4C. The contact stud 54 extends downward along the centerline of the axis of the fastening part 50 from the bottom of the top plate 51. The bottom edge of the contact stud 54 is at the same elevation as the lower edge of the cylindrical part 53. The lower edge of the contact stud 54 may be made slightly higher than the lower edge of the cylindrical part 53. An anti-slipping part (not shown) may be formed on the outer surface of the cylindrical part 53. The fastening part 50 (female thread 52) is screwed onto the attachment part 40 (male thread 46.)

A representative method for assembling and using the flag set will now be described. For example, the support arm 30 may be connected to the pole 10 as follows. First, the attachment part 40 is attached to the pole 10 as shown in FIG. 2. Then, the support arm 30 is inserted into the slit 47 and groove 48 in the attachment part 40 after the fastening part 50 has been removed from the attachment part 40. Then, the fastening part 50 is re-attached to the attachment part 40 as shown in FIGS. 2 through 4C. The support arm 30 is squeezed between the cylindrical part 53 (the lower part) of the fastening part 50 and the groove 48 (its bottom) of the attachment part 40 as shown in FIG. 3. By this action, the support arm 30 is anchored to the attachment part 40 (slit 47 and groove 48.) Therefore, the support arm 30 is connected to the pole 10 in such a manner that it can rotate about the axis of the pole 10.

At this time, the contact stud 54 (its bottom end) of the fastening part 50 comes into contact with the upper surface of the support arm 30. In the alternative, the contact stud 54 may be proximal to the fastening part 50 if the bottom of the contact stud 54 is made slightly higher than the bottom edge of the cylinder part 53. The support arm 30 tends to warp by having both ends of the support arm 30 sag downward, and the center part of the support arm 30 tends to push upward. The contact stud 54 pushing downward will counteract this tendency, and warping of the support arm 30 is substantially reduced or eliminated.

The flag units 20*a* and 20*b* (joint flag unit 21) may be attached to the support arm 30 before the support arm 30 is attached to the attachment part 40 (pole 10) as described above. In other words, the support arm 30 is inserted through the loops 26, which attach the flag unit to the support rod, on both flag units 20*a* and 20*b* ahead of time. Then, when the support arm 30 is attached to the attachment part 40 (pole 10), the pole 10 is inserted through the loops 22, which attach the flag unit(s) to the pole, to attach the flag units 20*a* and 20*b* (joint flag unit 21) to the pole 10.

After the flag units 20*a* and 20*b* (joint flag unit) are attached to the support arm 30, the loop 26 located at the front edge of the flag units 20*a* and 20*b* is hooked onto the hook 35 (hook part 37). Shifting of the flag units 20*a* and 20*b* on the support arm 30 can be prevented by this arrangement.

In this flag set, the support arm 30 can be connected to the pole 10 even when both hooks 35 are attached to both ends of the support arm 30. Consequently, both hooks 35 are fixed onto the support arm 30, ahead of time, and misplacing the hooks can be prevented.

Second Representative Embodiment

Figure 5:
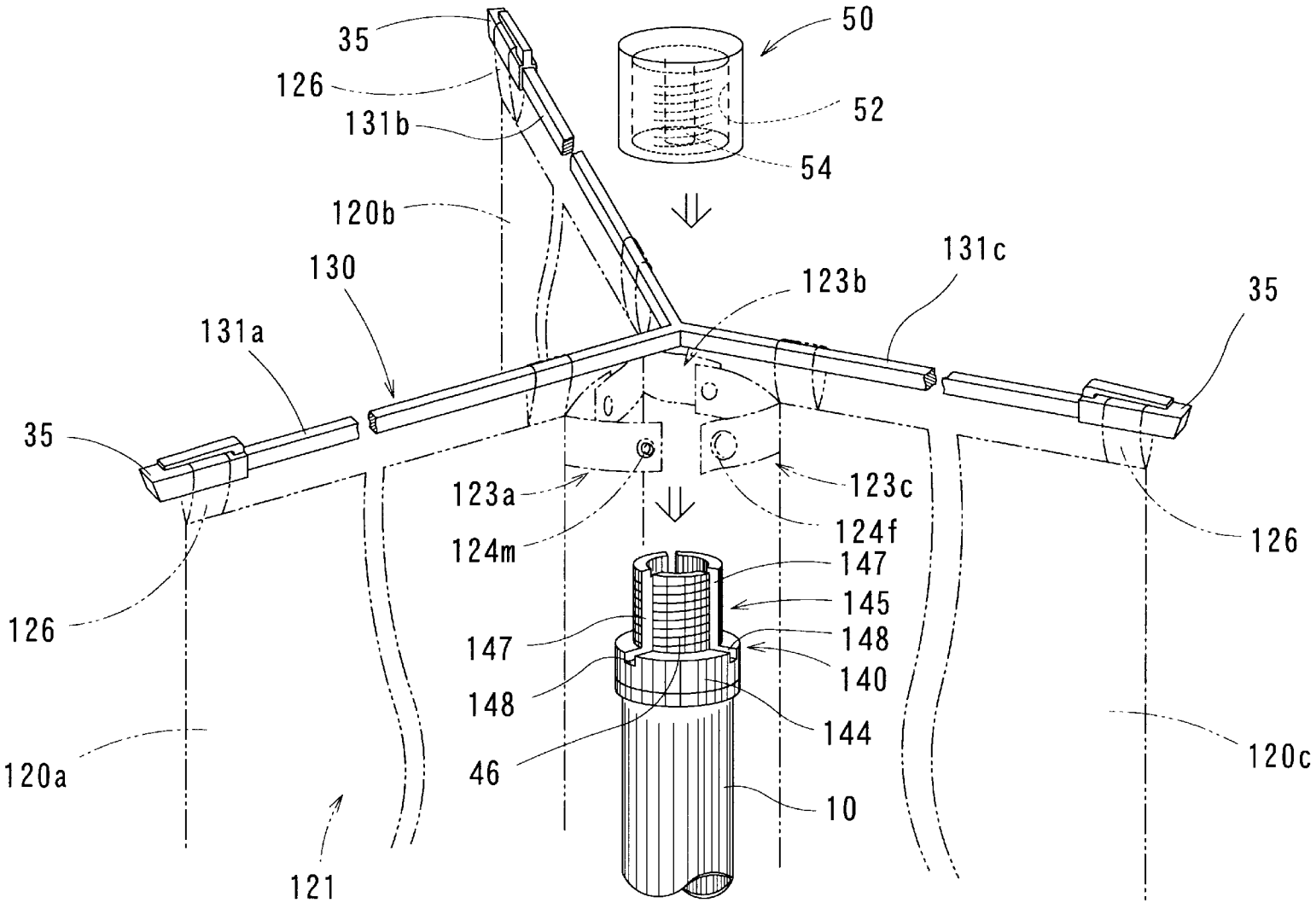
FIG. 5 shows an oblique view of certain portions of a second representative embodiment in a disassembled state.
Figure 6:
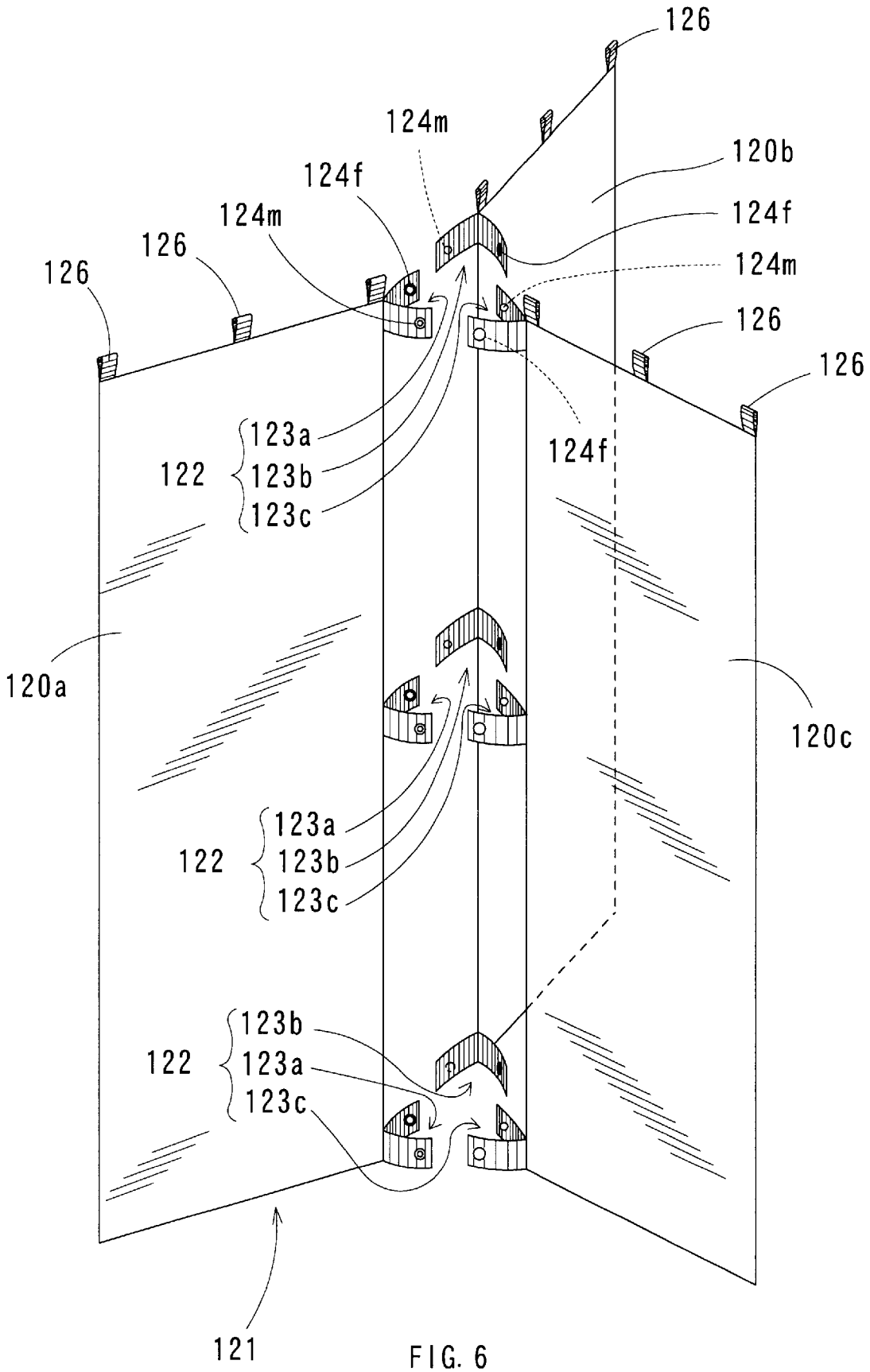
FIG. 6 shows an oblique view of the flag set (joint flag unit) of the second representative embodiment.

Referring to FIGS. 5 and 6, differences between the first representative embodiment and the second representative embodiment will be described. Common or corresponding parts in both embodiments have been assigned the same reference numbers and a detailed description of such common parts is thus not necessary.

The second representative flag set may include a pole 10, three flag units 120*a*, 120*b*, 120*c* (joint flag unit 121,) support arm 130, attachment part 140, and a fastening part 50 as shown in FIG. 5. The three flag units 120*a*, 120*b*, and 120*c* (i.e. the inside edges) are connected to each other by a plurality (three in the figure) of loops 122, which attach the flag unit(s) to the pole. A joint flag unit 121 is formed in this manner. A plurality of loops 126 attach the flag unit to the support rod and the loops 126 are provided at the top edge of each flag unit 120*a* through 120*c*.

Each loop 122 that attaches the flag unit(s) to the pole may be divided into three divided parts 123*a*, 123*b*, and 123*c*. Each divided part 123*a*–123*c* may extend to the left and right directions from the inside edge of each flag unit 120*a*–120*c*. A coupling part 124*m* may be attached at one end of each divided part 123*a* through 123*c*. More precisely, the coupling part 124*m* is attached near the end of each divided part 123*a*–123*c* and the same is true hereafter. A coupling part 124*f* is preferably attached to the other end of the divided part. The coupling part 124*m* may consist of a male hook and the coupling part 124*f* may consist of a female hook. A male surface fastener and a female surface fastener may be used instead. By connecting each adjacent coupling part 124*m* and 124*f*, a loop 122 for attaching the flag unit(s) to the pole is formed.

The support arm 130 may include support rods 131*a*, 131*b*, and 131*c*, as shown in FIG. 5. The three support rods 131*a*–131*c* extend radially outward at equal angular intervals (120°). Hooks 35 may be attached at each end of the support arm 130 (support rod 131*a*, 131*b*, and 131*c*).

A connecting part 145 of the attachment part 140 may have a cylindrical shape. A male thread 46 can be formed on its outer periphery. Three slits 147 are formed in the connecting part 145 to form attachment slots. Each attachment slot 147 is formed outward from the center in three directions at equal angular intervals (120° intervals). The slits 147 extend from the top of the connecting part 145 downward until they reach the upper part of the flange 144. In other words, corresponding grooves 148 are formed on the upper surface of the flange 144. The grooves 148 extend radially outward from the center in three directions at equal angular intervals (120° intervals).

The support arm 130 and the pole 10 may be connected in this embodiment in the same manner as in the first embodiment. In other words, the fastening part 50 is first removed. Then, the support arm 130 is inserted into the attachment part 140, which includes the slits 147 and grooves 148. Then, the fastening part 50 is re-attached to the attachment part 140 to anchor the support arm 130 to the attachment part 140 (slits 147 and grooves 148).

The flag units 120*a* through 120*c* point flag unit 121) may be installed in the following manner. First, each loop 122 is separated to form three groups of divided parts of the loops 123*a* through 123*c*. Then, after the support arm 130 is connected to the pole 10, as described above, each flag unit 120*a* through 120*c* (loops 126 for attaching the flag unit(s) to the support rod(s)) is attached to each support rod 131*a* through 131*c* of the support arm 130. Then, each of the three divided parts 123*a* through 123*c* of the loop is coupled to form a loop 122 to attach each flag unit 120*a* through 120*c* to the pole 10.

Naturally, this procedure may be reversed. In other words, each flag unit 120*a* through 120*c* may be attached to the support arm 130 before the support arm 130 is connected to the pole 10. Then, after the support arm 130 is connected to the pole 10, each flag unit 120*a* through 120*c* may be attached to the pole.

All hooks 35 can be attached permanently to the support arm 130 ahead of time in this flag set similar to the first embodiment. Therefore, misplacement of hook 35 can be prevented. In addition, three flag units 120*a* 120*b*, and 120*c* can be attached to the pole 10 in this flag set, thereby giving a novel impression to the viewer. Additionally, in this representative embodiment, three flag units 120*a* through 120*c* can be attached easily onto one pole 10 and all flag units 120*a* through 120*c* can be attached to the pole 10 at the same height. Further, the joint flag unit 121 can rotate about the axis of the pole 10 by the wind or by human hands in this flag set. Consequently, the viewers can see all flag units 120*a* through 120*c*. This is true with the other representative embodiments, as well.

In the second representative flag set, only the upper loops of the plurality (e.g., three) of loops 122 for attaching the flag unit(s) to the pole may be separated into three divided parts (123*a* through 123*c*). The lower loop may be left undivided. In this case, the joint flag unit 121 (each flag unit 120*a* through 120*c*) is first attached to the support arm 130 (each support rod 131 a through 131*c*). Then, the joint flag unit 121 may be attached to the pole 10 while the support arm 130 is being attached to the pole 10 (attachment part 140). This operation can be performed with the other embodiments, as well.

Third Representative Embodiment

Figure 7:
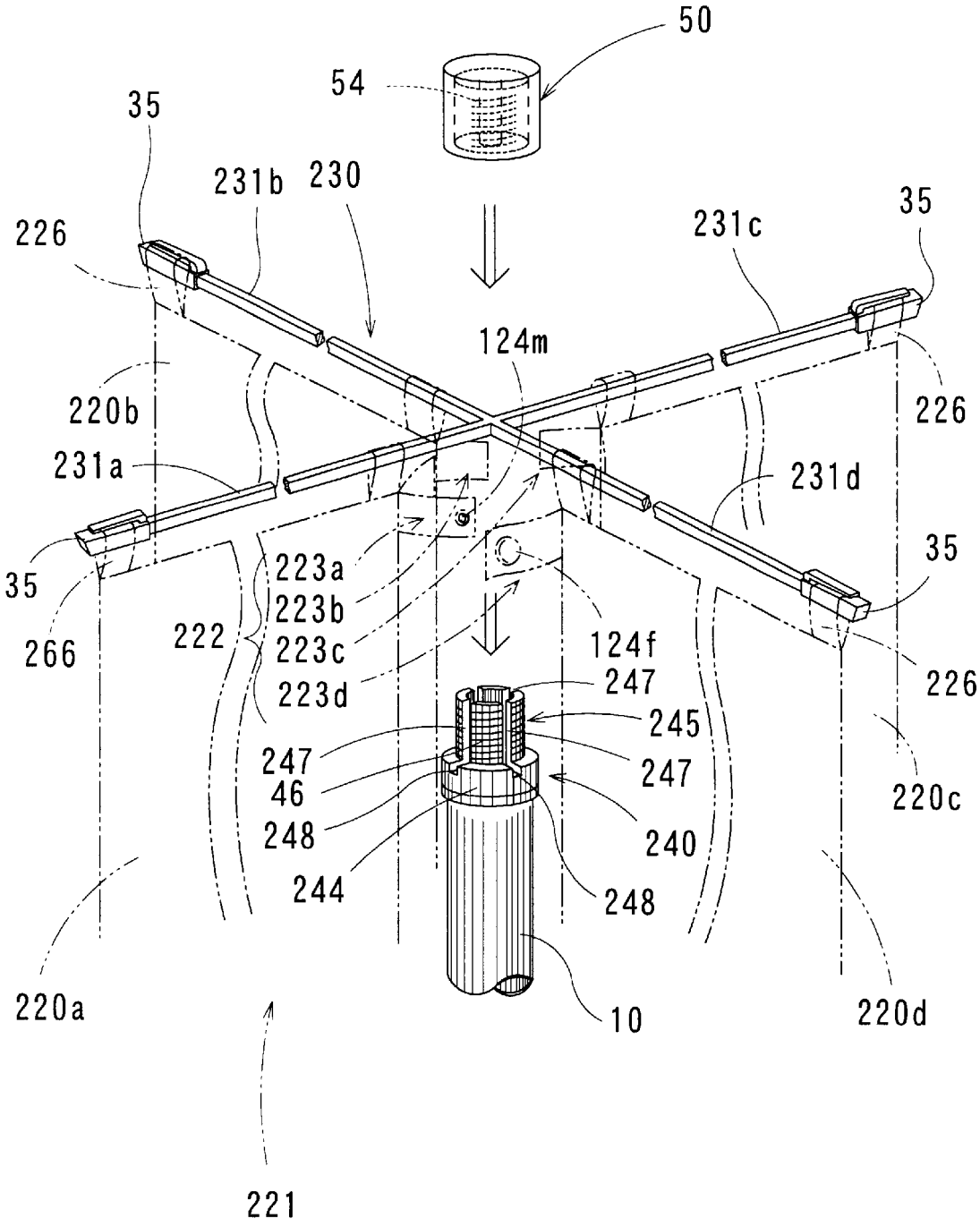
FIG. 7 shows an oblique view of certain portions of a third representative embodiment in a disassembled state.

Referring to FIG. 7, a third representative embodiment will be described as a variation of the flag set of the second representative embodiment. Therefore, only the differences between the two representative embodiments will be explained.

The flag set of this embodiment may include a pole 10, four sheets of flag units 220*a*, 220*b*, 220*c* and 220*d* (joint flag unit 221), support arm 230, attachment part 240 and a fastening part 50. The four sheets of flag units 220*a* through 220*d* may be connected by a plurality of loops 222, which attach the flag unit(s) to the pole, to form a joint flag unit 221. A plurality of loops 226, which attach the flag unit(s) to the support rod(s), may be provided at the top edge of each flag unit 220*a* through 220*d*. Each loop 222 may be divided into four groups of divided parts 223*a* through 223*d*, and they can be attached or detached by the coupling parts 124*m* and 124*f*.

The support arm 230 may include four support rods, 231*a*, 231*b*, 231*c*, and 231*d*. The four support rods 231*a* through 231*d* radially extend outward at equal angular intervals (90° angular intervals). A hook 35 is attached to each end of the support arm 230 (support rods 231*a* through 231*d*). Four slits 247 may be formed in the connecting part 245 of the attachment part 240 and grooves 248 may extend radially outward from the center at equal angular intervals (90° angular intervals).

In this flag set, the support arm 230 is connected to the pole 10 in the same manner as in the flag set of the second representative embodiment. The flag sets 220*a* through 220*d* are attached to the support arm 230 and to the pole 10 in the same manner as in the flag set of the second representative embodiment, as well. Because four flag units 220*a* through 220*d* are attached to the pole 10, a novel impression is given to the viewer.

Fourth Representative Embodiment

Figure 8:
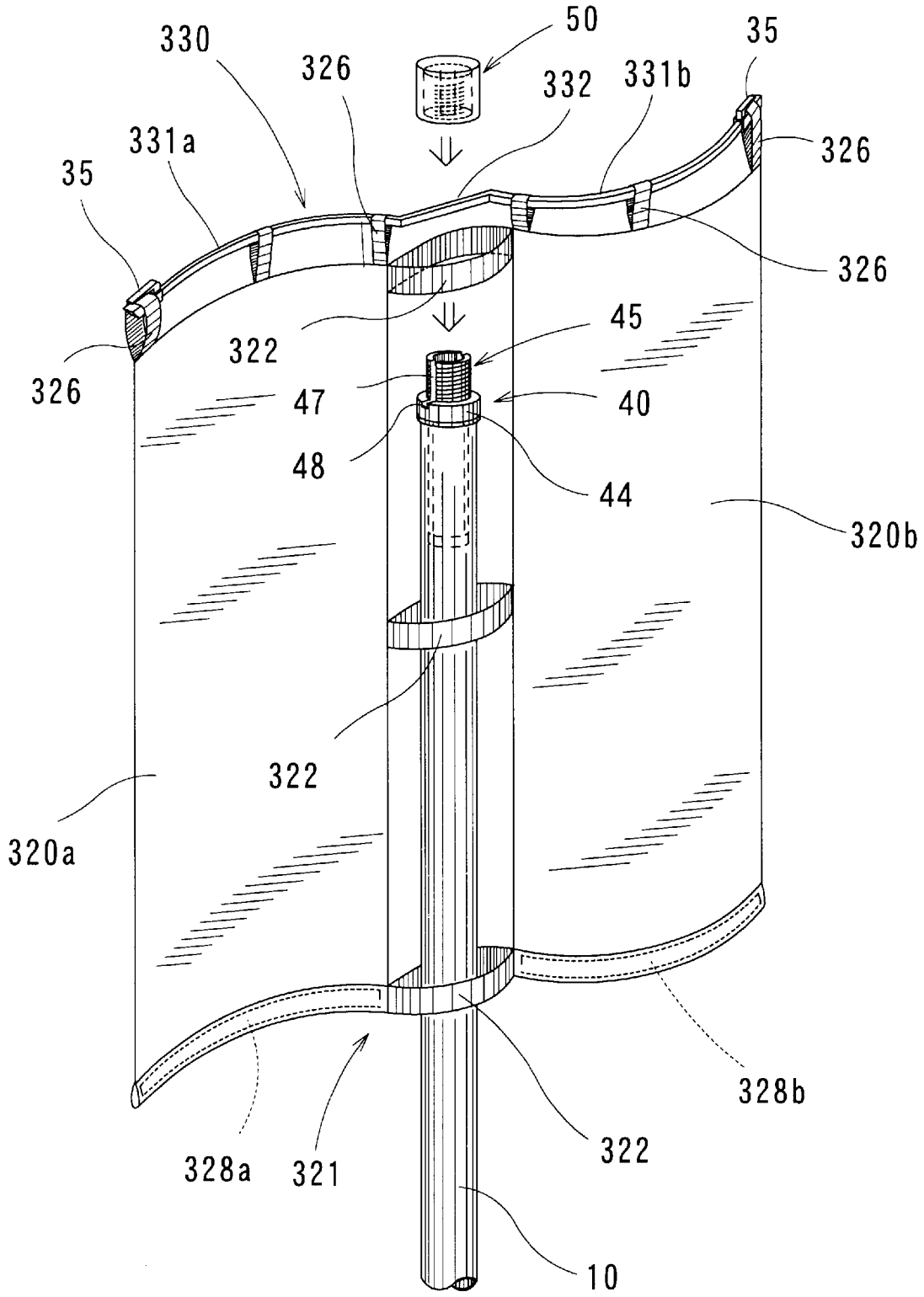
FIG. 8 shows an oblique view of certain portions of a fourth representative embodiment in a disassembled state.

Referring to FIG. 8, an explanation of the differences between the fourth representative embodiment and the first representative embodiment will be provided. This flag set may include a pole 10, two sheets of flag units 321*a*, 320*b*, (joint flag unit 321), support arm 320, attachment part 40 and a fastening part 50. The two flag units 320*a* and 320*b* may be connected by a plurality of loops 322, which attach the flag unit(s) to the pole, to form a joint flag unit 321. The loops 322 may be divided into two groups of divided parts of loops that can be attached or detached, which is the same as the flag set of the second representative embodiment. This is true of the loops 22 in the first representative embodiment, as well. A plurality of loops 326, which attach the flag set to the support rods, are provided on the top edge of each flag unit 320*a* and 320*b*.

The support arm 330 may be formed as a single rod. In the alternative, the support arm 230 can be considered as separate support rods 331*a* and 331*b* connected at a 180° interval. The support arm 330 may include an insertion part 332 and a pair of support rods 331*a* and 331*b* extending outward in both directions. The insertion part 332 is formed as a straight bar, but the support rods 331*a* and 331*b* are curved in an arc shape. Both support rods 331*a* and 331*b* are formed in a point symmetrical arc shape centered about the insertion part 332. In order to make the flag units conform to this shape, foundation materials 328*a*, 328*b* are disposed inside the bottom edges of the flag units 320*a* and 320*b*. Each foundation material 328*a*, 328*b* is formed in an arc shape to conform to the shape of each support rod 331*a* and 331*b*.

In this flag set, the support arm 330 and the pole 10 may connected in substantially the same manner as in the first representative embodiment. In other words, after the fastening part 50 is removed from the attachment part 40, the support arm 330 (its insertion part 332) is inserted into the slits 47 and grooves 48 of the attachment part 40. Then, the fastening part 50 is replaced onto the attachment part 40 to anchor the support arm 330 to the attachment part 40 (slit 47 and groove 48.)

The flag units 320*a* and 320*b* may be attached to the support arm 330 before the support arm 330 is attached to the pole 10 (attachment part 40) in the same manner as in the first representative embodiment. Further, when the support arm 330 is attached to the attachment part 40 (pole 10), the pole can be passed through the loops 322 to attach the flag units 320*a* and 320*b* to the pole 10. If the loops 322 are divided into divided parts, the flag units 320*a* and 320*b* can be attached to the support arm 330 (support rods 331*a*, 331*b*) with the divided parts opened, as described in the second representative embodiment. As a result, the divided parts of both loops can be connected to attach the flag units to the pole.

In this flag set, it is possible to attach both hooks 35 ahead of time to the support arm 330 the same as in the flag set of the first representative embodiment. Therefore, misplacement of the hooks 35 can be prevented. In addition, in this flag set, a support arm 330 having a curved arc shape can be connected to the pole 10, as described above. The flag units 320*a* and 320*b* form a curved shape having an arc shaped cross section by the actions of each support rod 331*a* 331*b*, and the foundation material 328*a* and 328*b*. Consequently, the flags units give a novel impression to the viewers.

The embodiment can be easily modified in the following manner. The pair of support rods (331*a* and 331*b*) can be formed symmetrically about an imaginary line that orthogonally intersects the insertion part 332. In other words, the flag units may form a convex shape in the same direction. In addition, the support arm may consist of more than three support rods.

Fifth Representative Embodiment

Figure 9:
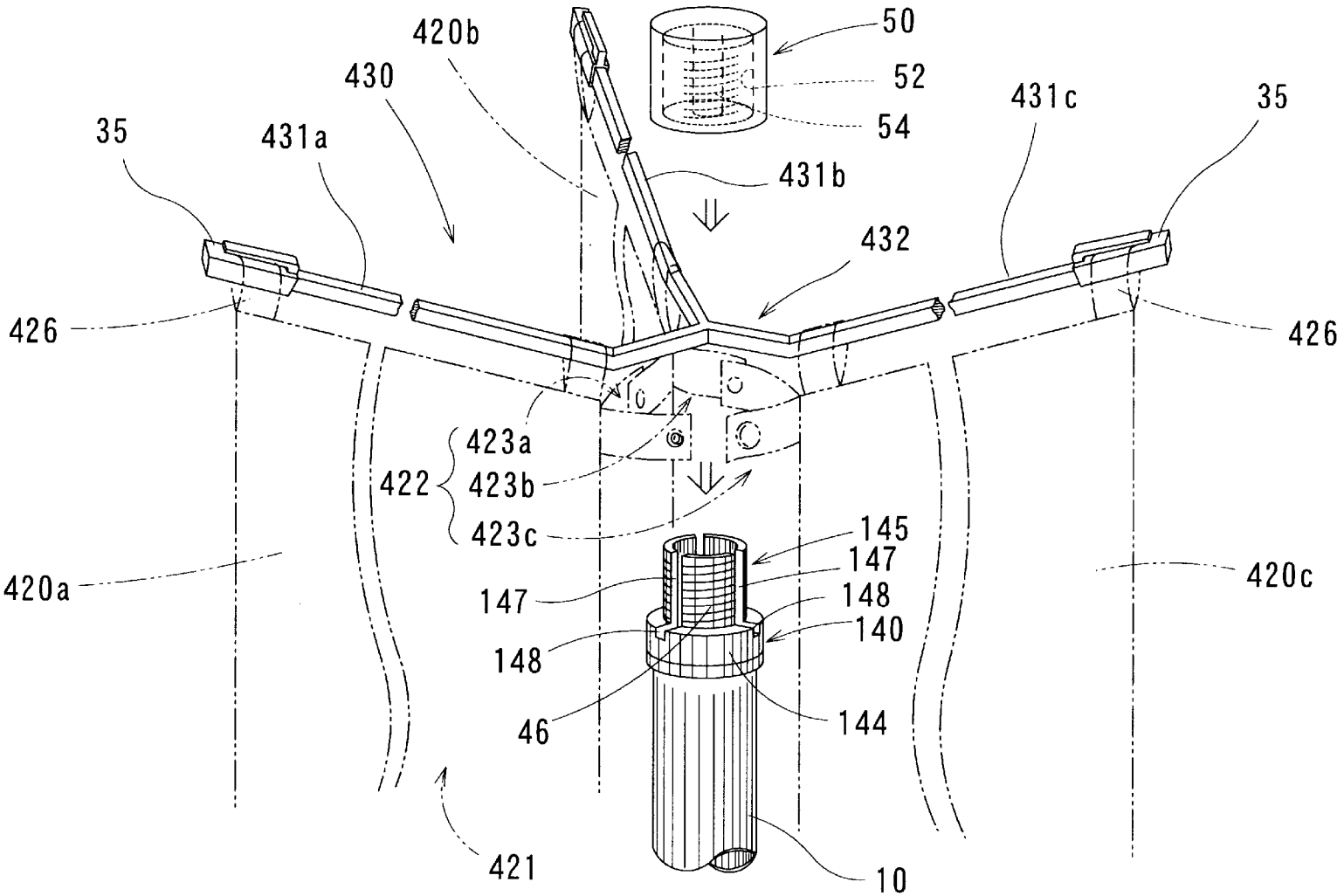
FIG. 9 shows an oblique view of certain portions of a fifth representative embodiment in a disassembled state.

Referring to FIG. 9, the differences between the fifth representative embodiment and the second representative embodiment will be described. This flag set may include a pole 10, three sheets of flag units 420*a*, 420-*b*, 420*c* (joint flag unit 421), support arm 430, attachment part 140 and a fastening part 50. The support arm 430 preferably includes three support rods 431*a*, 431*b*, and 431*c* and the three support rods 431*a* through 431*c* extend outward radially at equal angular intervals (in 120° angular intervals). The center part of the support arm 430 of the support rods 431*a* through 431*c* extends out horizontally and forms the insertion part 432. Each part of support rods 431*a* through 431*c* extending outward away from the insertion part 432 is bent diagonally upward from the insertion part 432. In this specification, "horizontal" is an expression referring to the condition in which the support arm 430 is connected to the pole 10 and the pole 10 is placed in a vertical position. This also applies to the expression "diagonally upward."

The top edges of the three flag units 420*a* through 420*c* are formed diagonally conforming to each support rods 431*a* through 431*c* of the support arm 430. The three flag units 420*a* through 420*c* are connected together with a plurality of loops 422, which are used for attaching the flag units to the pole, to form a joint flag unit 421. Each loop may be divided into three divided parts 423*a*, 423*b*, and 423*c*, which can be attached to or detached from each other. A plurality of loops 426, which are used to attach the flag unit(s) to the support rod(s), are provided on the top edge of each flag units 420*a* through 420*c*.

In this flag set, the support arm 430 is connected to the pole 10 in the same manner as in the second representative embodiment as described above. In other words, with the fastening part 50 removed from the attachment part 140, the support arm 430 (its insertion part 432) is inserted into the slits 147 and grooves 148 formed on the attachment part 140. Then, the fastening part 50 is reattached to the attachment part 140 to anchor the support arm 430 to the attachment part 140 (slits 147 and grooves 148). The flag units 420*a* through 420*c* may be attached to the support arm 430 and the pole 10 in the same manner as in the flag set of the second representative embodiment. Moreover, the same operating effects realized in the second representative embodiment can be realized in this flag set, as well.

In addition, in this flag set, each support rods 431*a* through 431*c* of the support arm 430 can be attached to the pole 10 even if the support rods are tilted diagonally upward. Each support rods 431*a* through 431*c* of the support arm 430 is formed to tilt diagonally upward. Consequently, the flag set can give a novel impression to the viewers.

As a variation of this embodiment, a support arm (430) having two or more or four or more support rods can be made. These support rods may be tilted diagonally upward or tilted downward.

Sixth Representative Embodiment

Figure 10:
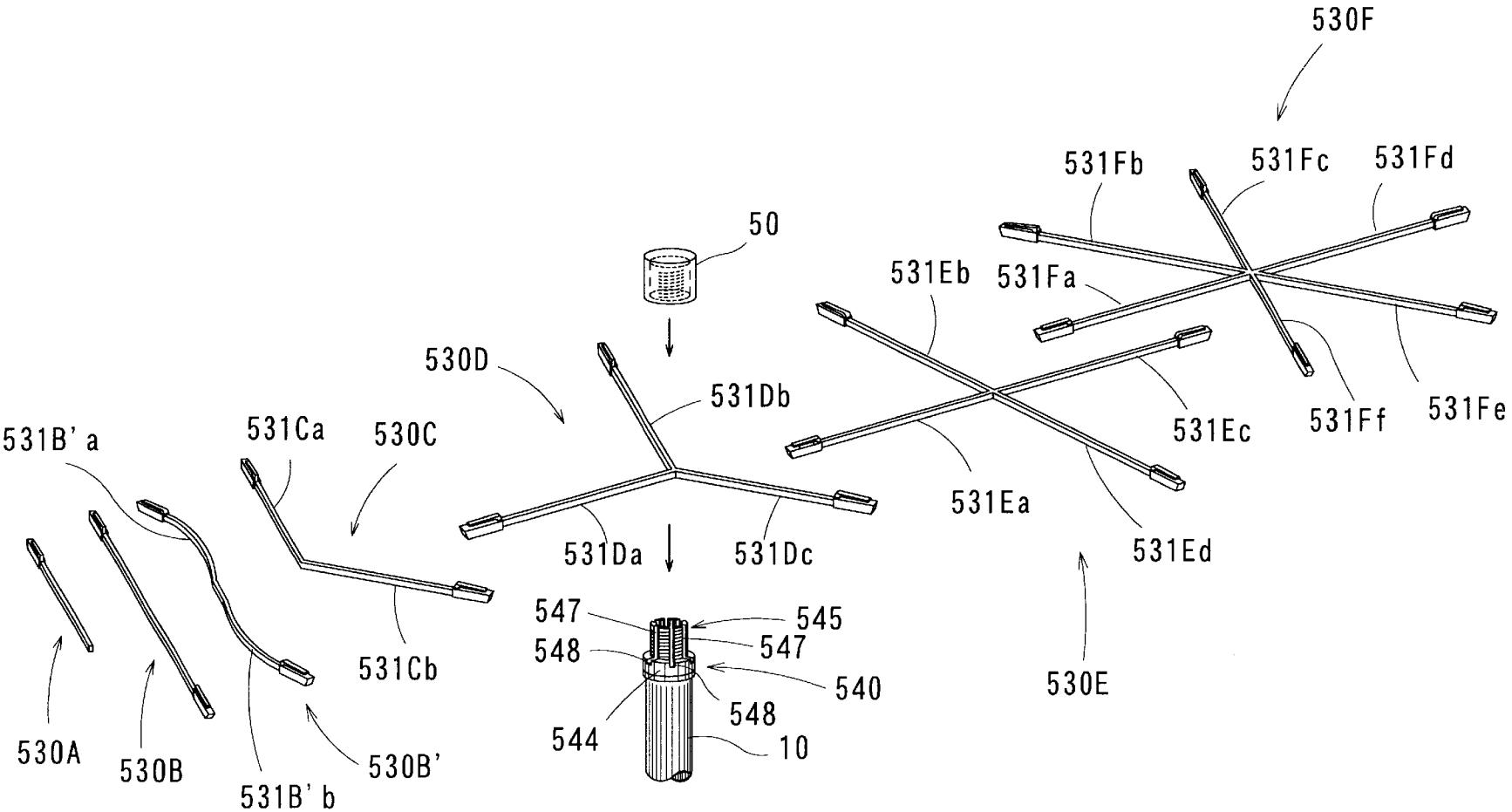
FIG. 10 shows an oblique view of certain portions of a sixth representative embodiment in a disassembled state.
Figure 11:
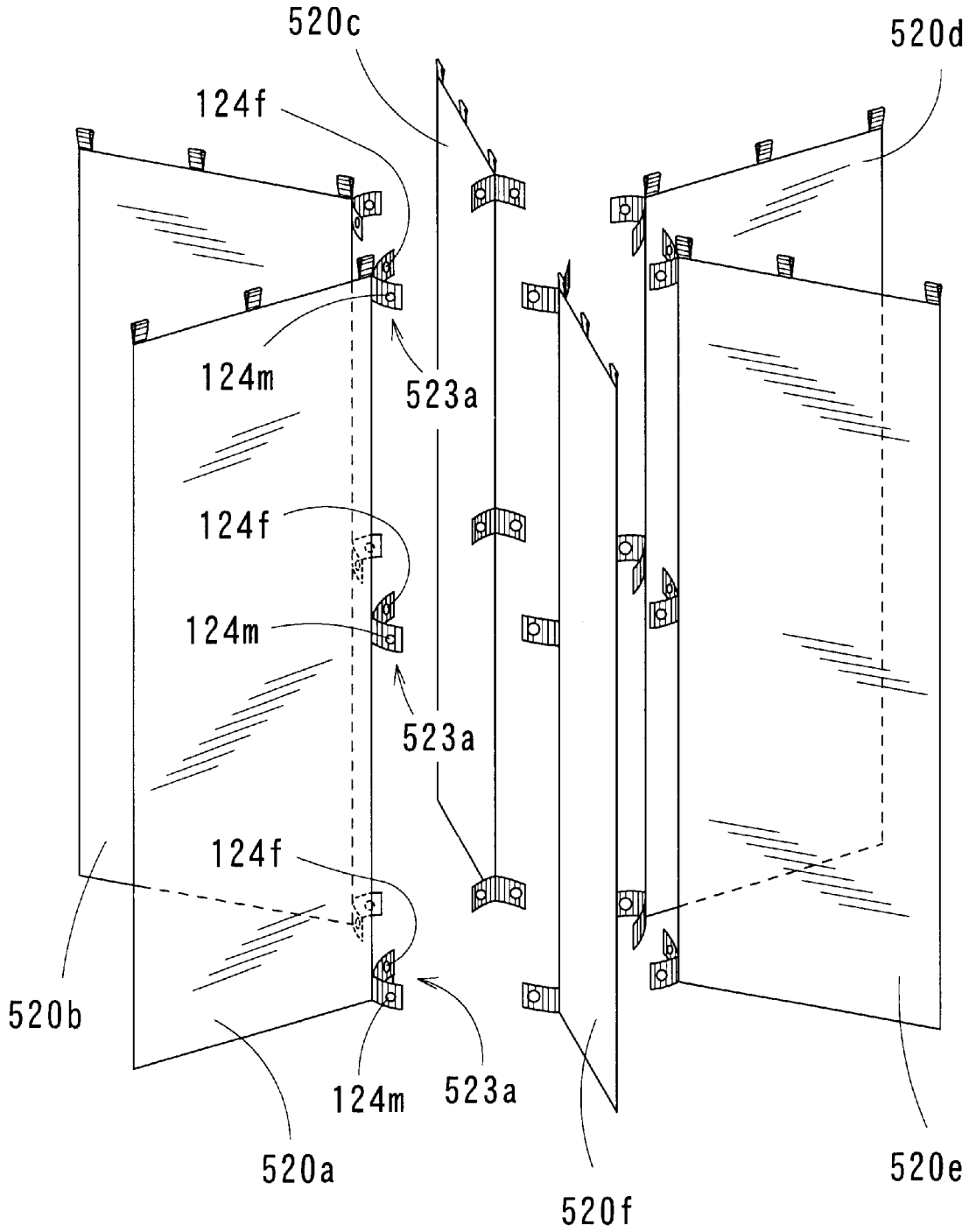
FIG. 11 shows an oblique view of the sixth representative embodiment.
Figure 12:
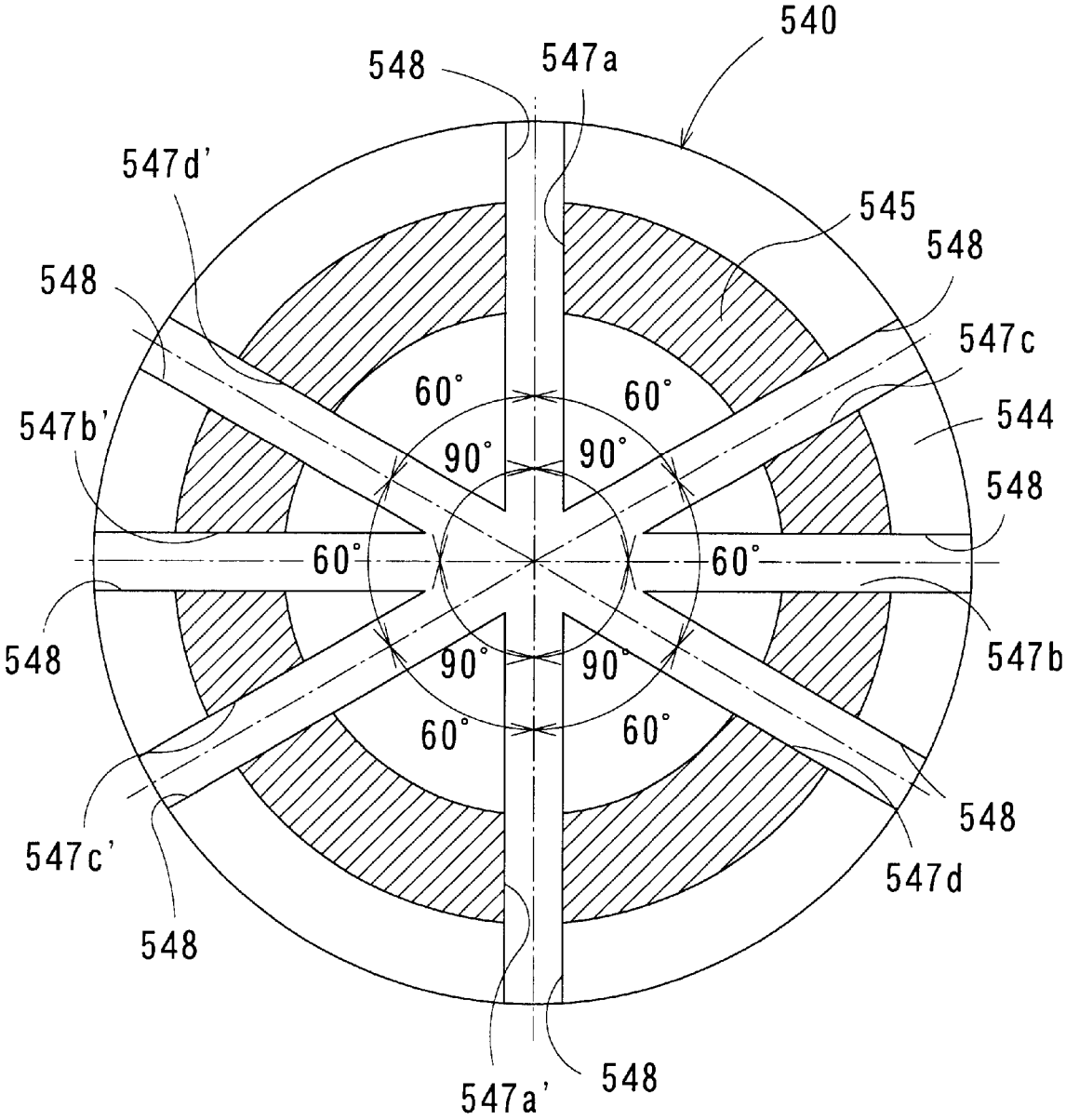
FIG. 12 shows a cross-sectional view of the attachment part of the sixth representative embodiment.

Referring to FIGS. 10 through 12, an explanation of the differences between the sixth representative embodiment and the flag sets of the first embodiment through the fifth embodiment will be provided. As shown in FIGS. 10 and 11, the flag set may include a pole 10, flag unit groups (520*a*, 520*b*, 520*c*, . . .), support arm groups (530A, 530B, 530C, . . . ), attachment part 540 and a fastening part 50.

Referring to FIG. 11, the flag unit groups may include a plurality (e.g., six) of flag units 520*a* through 520*f*. On each flag unit 520*a* through 520*f*, a plurality (e.g., three) of divided parts of loops 523*a* through 523*f* (only 523*a* is identified by a reference number in FIG. 11) are provided at the same elevations. As explained in further detail in the second representative embodiment, each divided part of the loops 523*a* through 523*f* extends to the left and right directions at the inside edge of each flag unit 520 a through 520*f*. A coupling part 124*m* is attached to one end of each divided part of the loop 523*a* through 523*f* and a coupling part 124*f* is attached to the other end of the divided part of the loop.

Any desired number (e.g., one, two, three, four, or six sheets) of flag units 520*a*, 520*b*, . . . may be selected from the flag unit groups and can be connected together with the coupling part 124*m* and coupling part 124*f*. At this time, the divided parts of the loop 523*a*, 523*b*, . . . may be coupled to form a loop to attach the flag unit(s) to the pole 10. When only one sheet is used (for instance, flag unit 520*a*) the coupling part 124*m* and the coupling part 124*f* of the same flag unit 520*a* are connected.

Referring to FIG. 10, the support arms group may include a multitude of support arms. Various support arms, such as a unidirectional straight rod support arm 530A, bi-directional straight rod support arm 530B, bi-directional curved rod support arm 530B', bi-directional bent shape support arm 530C, tri-directional support arm 530D, quadri-directional support arm 530E, and six-directional support arm 530F, and others may be prepared.

Representative examples of each of these support arms will be provided. For example, the unidirectional straight rod support arm 530A may be generally shaped as a straight rod. It is used to attach one flag unit (520*a*) to the pole in one direction with respect to the pole. The bi-directional straight rod support arm 530B may be generally shaped as a straight rod (corresponds to the support arm 30 of the first embodiment). The bi-directional curved rod support arm 530B' may be generally shaped as a curved rod (corresponds to the support arm 330 of the fourth embodiment). The bi-directional bent support arm 530C may be shaped as if it was bent in the middle to form an angle of about 120°. The tri-directional support arm 530D may consist of three support rods 531D*a*, 531D*b*, 531D*c* radiating outward at equal angular intervals (120° interval). In this case, tri-directional support arm 530D will correspond to the support arm 130 of second representative embodiment. The quadri-directional support arm 530E may consist of four support rods 531E*a* through 531E*d* radiating outward at equal angular intervals (90° intervals) and may correspond to support arm 230 of the third representative embodiment. The six-directional support arm 530F may consist of six support rods 531F*a*, 531F*b*, . . . , 531F*f* radiating outward at equal angular intervals (60° intervals). Hooks may be permanently fixed at the ends of every support rod of the support arm 530B, . . . , 530F (the symbols are omitted in the figure), except in the support arm 530A where a hook is fixed only at one end (reference number is omitted in the figure).

The attachment part 540 may include a cylindrical connecting part 545. Four pairs of slits 547*a*/547*a*', 547*b*/547*b*', 547*c*/547*c*', and 547*d*/547*d*' may be formed in the connecting part 545 as shown in FIG. 12. The slits 547*a*/547*a*' and the slits 547*b*/547*b*' are formed at a 90° interval. The slits 547*a*/547*a*', slits 547*c*/547*c*', and slits 547*d*/547*d*' are formed at 60° intervals. Each slit 547*a* through 547*d*' may extend downward to reach the upper part of the flange 544. In other words, the groove 548 is formed on the upper part of flange 544 in a shape corresponding to the slits. The grooves 548 extend radially outward in eight directions from the center of the flange 544.

Of the support arms group (FIG. 10), the unidirectional straight rod shaped support arm 530A, the bi-directional straight rod shaped support arm 530B and the bi-directional curved rod shaped support arm 530B' can be inserted into, for example, slits 547*a*, 547*a*' (including the corresponding grooves 548.) This is the same hereafter. The bi-directional bent support arm 530C can be inserted into, for example, slits 547*a*, 547*d*'. The tri-directional support arm 539D can be inserted into, for example, slits 547*a*, 547*c*', and 547*d*. The quadri-directional support arm 530E can be inserted into, for example, slits 547*a*, 547*a*', 547*b*, and 547*b*'. The six-directional support arm 530F can be inserted into, for example, slits 547*a*, 547*a*', 547*c*, 547*c*', 547*d* and 547*d*'. All support arms 530A through 530F can be inserted into the attachment part 540 (slits 547*a*/547*a*', . . . , 547*d*/547*d*', and grooves 548) in this manner.

In this flag set, the most suitable combination of flag set and support arm can be selected from the flag set group (FIG. 11) and support arm group (FIG. 10). In other words, the following combinations are available for selection:

(a) a combination of one flag unit 520*a* and the unidirectional straight rod shaped support arm 530A, (b) a combination of two flag units 520*a*/520*b* and the bi-directional straight rod shaped support arm 530B or the bi-directional curved rod shaped support arm 530B', (c) a combination of two flag units 520*a*/520*b* and the bi-directional bent shaped support arm 530C, (d) a combination of three flag units 520*a* through 520*c* and the tri-directional support arm 530D, (e) a combination of four flag units 520*a* through 520*d* and the quadri-directional support arm 530E, and (f) a combination of six flag units 520*a* through 520*f* and the six-directional support arm 530F.

In either combination, the support arm (530A, 530B, 530C, . . . ) is inserted into the attachment part 540 (slits and grooves formed for insertion). Then, the fastening part 50 is attached to anchor the support arm to the attachment part 540 (slits and grooves formed for insertion) and the support arm is connected to the pole 10. Then, the flag unit (520*a*, 520*b*, . . . ) is attached to the pole 10 and its support arms (530A, 530B, . . . ). A multitude of exterior appearances can be composed to give novel impressions to the viewers.

Each flag unit 520*a* through 520*f* may be provided with a loop that wraps around the pole 10 independently without having each flag units 520*a*, 520*b*, . . . connected to one another. On the other hand, various joint flag units may be prepared independently ahead of time. These would include a flag unit with a single sheet, a joint flag unit with 2 flag units, a joint flag unit with 3 flag units, a joint flag unit with six flag units, and the like. Then, the desired form of flag unit may be selected.

Sales of the flag sets may be handled in such a manner that the entire lineup of flag sets is made available at the sales store and the buyer (user) may purchase the flag set with the desired combination. Alternatively, the buyer (user) may purchase the entire lineup of flag sets and use any desired combinations.

Seventh Representative Embodiment

Figure 13:
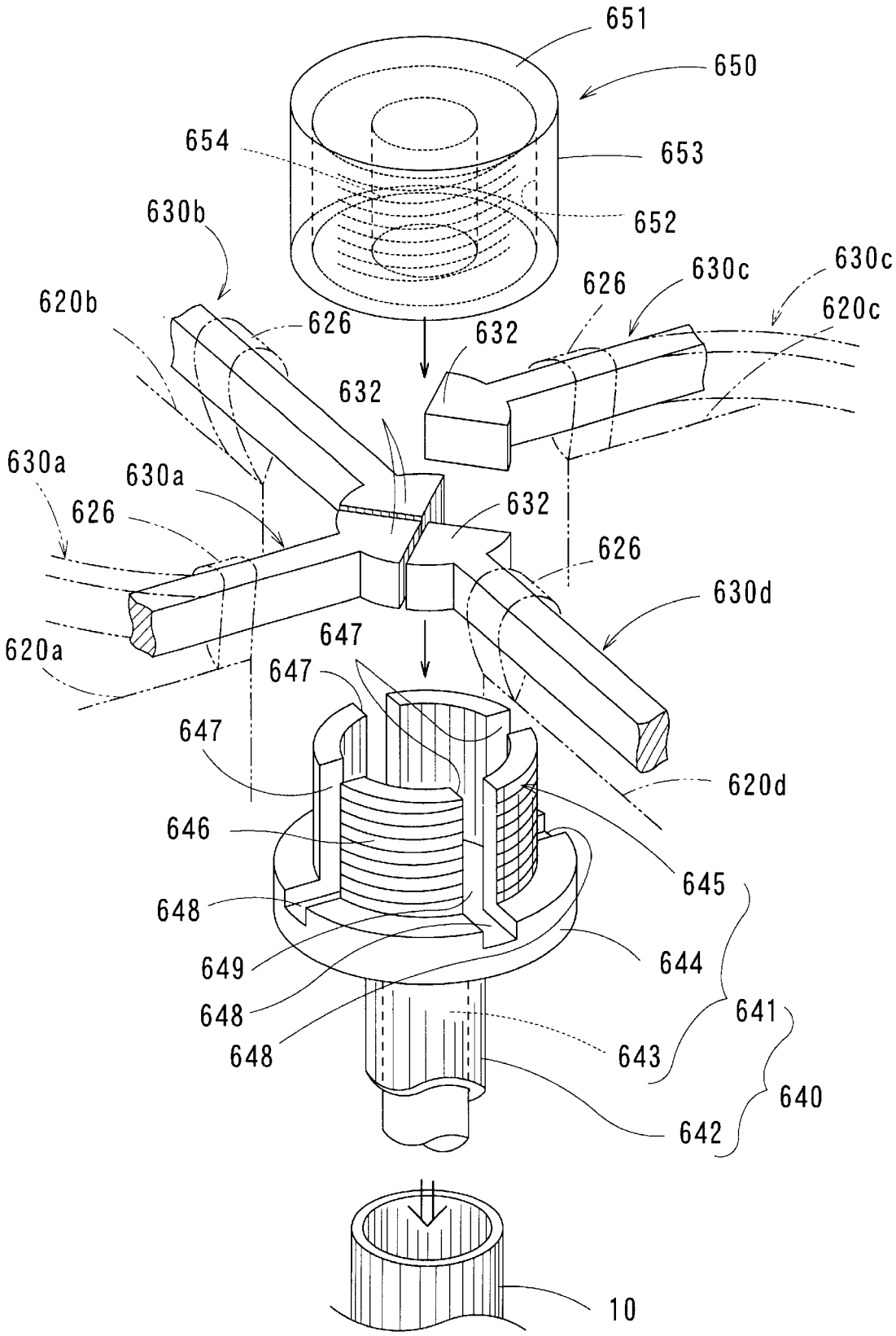
FIG. 13 shows an oblique view of certain portions of a seventh representative embodiment in a disassembled state.
Figure 14:
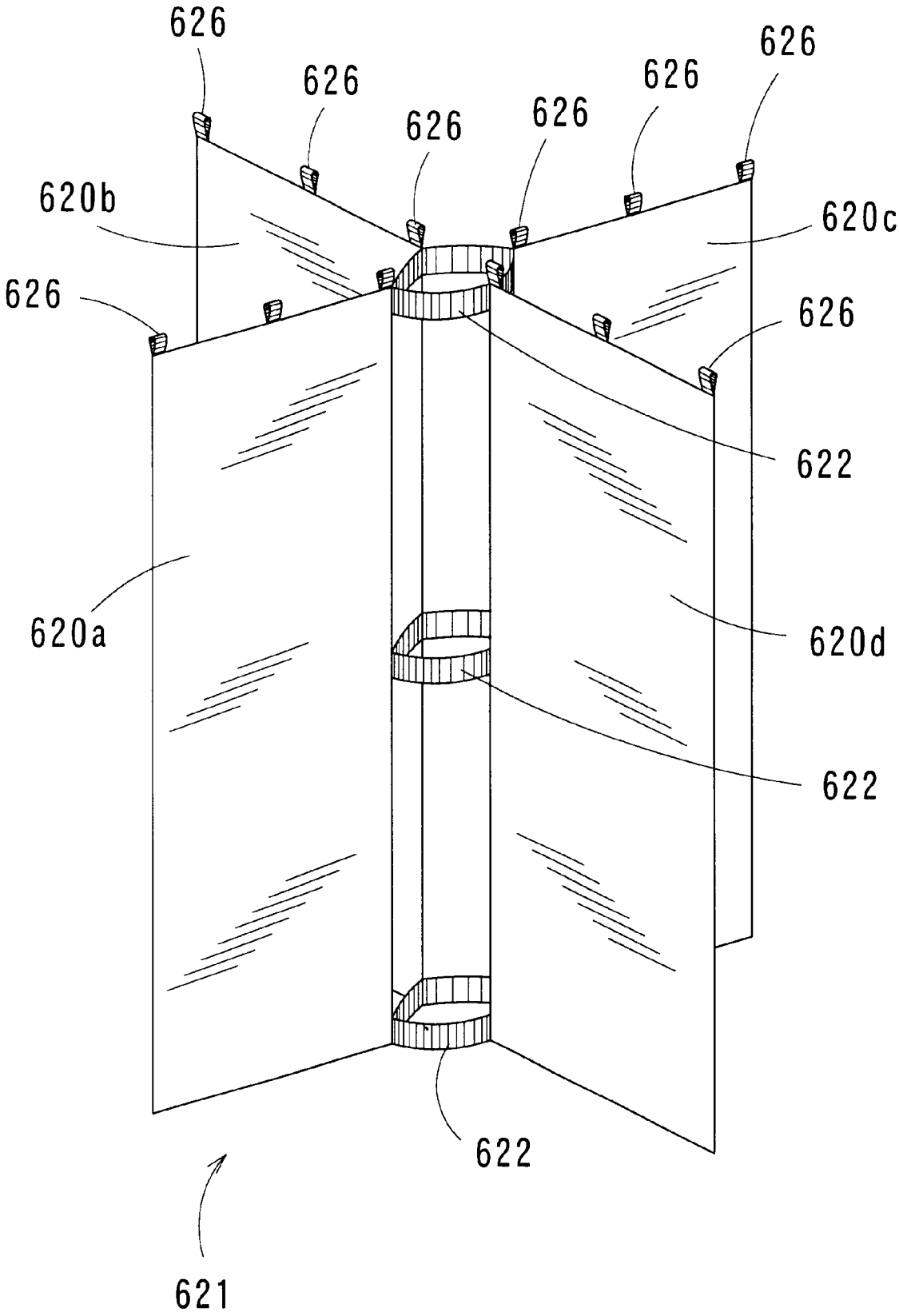
FIG. 14 shows an oblique view of the flag set (joint flag unit) of the seventh representative embodiment.

Referring to FIGS. 13 through 15, an explanation of the differences between the seventh representative embodiment and the flag set of the first representative embodiment will be provided. As depicted in FIGS. 13 and 14, this flag set may include a pole 10, four sheets of flag units 620*a*, 620*b*, 620*c*, and 620*d* (joint flag unit 621), support rods 630*a*, 630*b*, 630*c*, and 630*d*, attachment part 640 and a fastening part 650. It may be assembled and disassembled by the user.

A plurality of loops 622, which are used to attach the flag unit(s) to the pole, is provided vertically on all four sheets of flag units 620*a* through 620*d*, as shown in FIG. 14. In other words, four sheets of flag units 620*a* through 620*d* are connected (at their inside edges) by a plurality of loops 622 to form a joint flag unit 621. A plurality of loops 626, which are used to attach the flag unit to the support rod, are provided at the top edge of each flag unit 620*a* through 620*d*.

Support rods 630*a* through 630*d* are each formed in the shape of a straight rod and support rods 630*a* through 630*d* each have a rectangular cross section as shown in FIG. 13. At least one of the support rods (e.g., the support rods 630*a* and 630*c* shown in two-dot-dash lines) may be curved. An insertion part 632 may be provided at the base of support rods 630*a* through 630*d*, respectively. Each insertion part 632 is preferably formed in a shape resembling one quarter of an equally divided disc. Each insertion part 632 has the same height as the support rods 630*a* through 630*d*. The size of each insertion part 632 is preferably made to conform to the size of the inside of the connecting part 645 (described below) of the attachment part 640. In other words, the size of the disc formed when all four insertion parts 632 are joined together is approximately the same as the size of the inside of the connecting part 645. These support rods 630*a* through 630*d* collectively correspond to the support arm in other embodiments. In other words, the support rods 630*a* through 630*d* are formed by dividing the support arm into separate support rods.

Hooks 35 are preferably attached to the tip of each support rod 630*a* through 630*d*, as described above with reference to FIG. 1 and FIG. 2.

The attachment part 640 is preferably attached to the top of the pole 10 as shown in FIG. 13 and may include a main unit 641 and an outer cylinder 642. The main unit 641 preferably has a base axis 643 that is arranged in such a manner that it can rotate (slide) around the axis with respect to the outer cylinder 642. The outer cylinder 642 is fitted tightly to the top of the pole 10 (impossible to rotate around the axis). However, the base axis 643 and the parts above it can rotate around the axis with respect to the pole 10.

A flange 644 may be formed on top of the base axis 643 and a connecting part 645 may be formed on top of the flange 644. The flange 644 and the connecting part 645 are made larger than the flange 44 and connecting part 45 in the first embodiment. The connecting part 645 may have a cylindrical shape and a male thread 646 may be formed on its outer periphery.

Figure 15A:
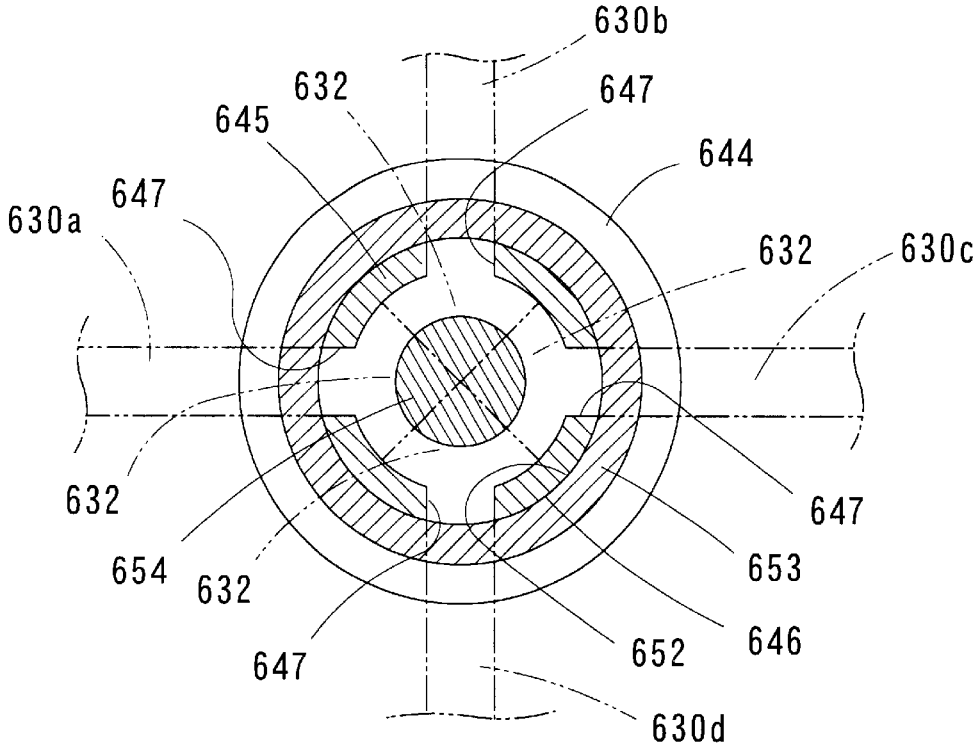
FIG. 15A and FIG. 15B show cross-sectional views of certain portions of the seventh representative embodiment.
Figure 15B:
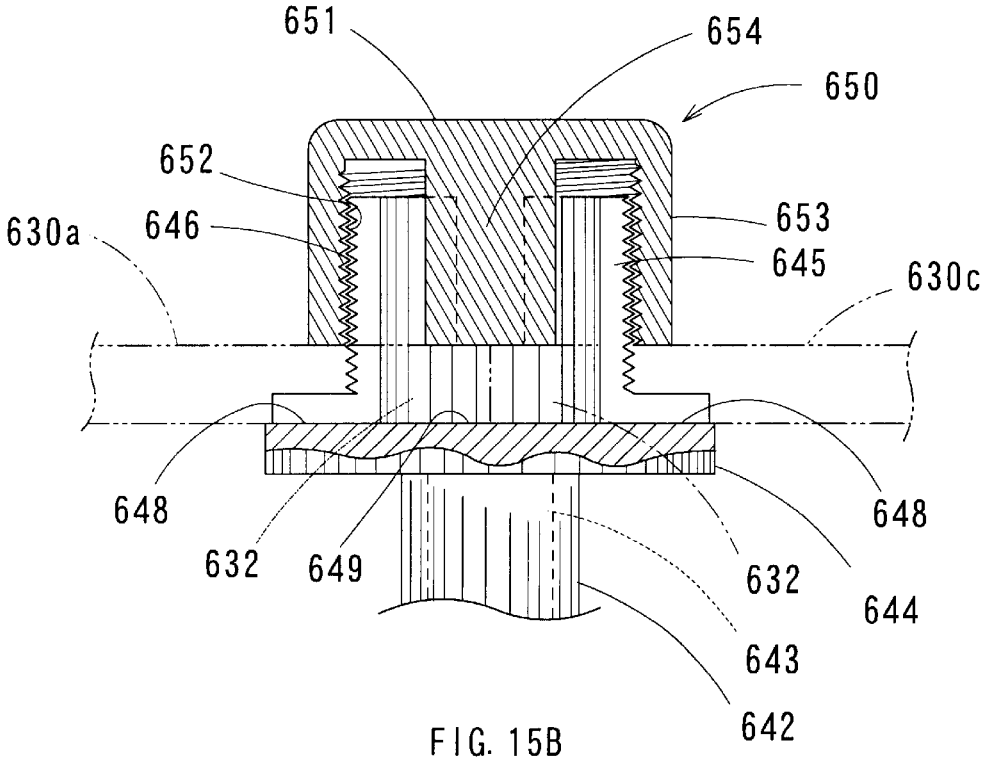
Figure 16:
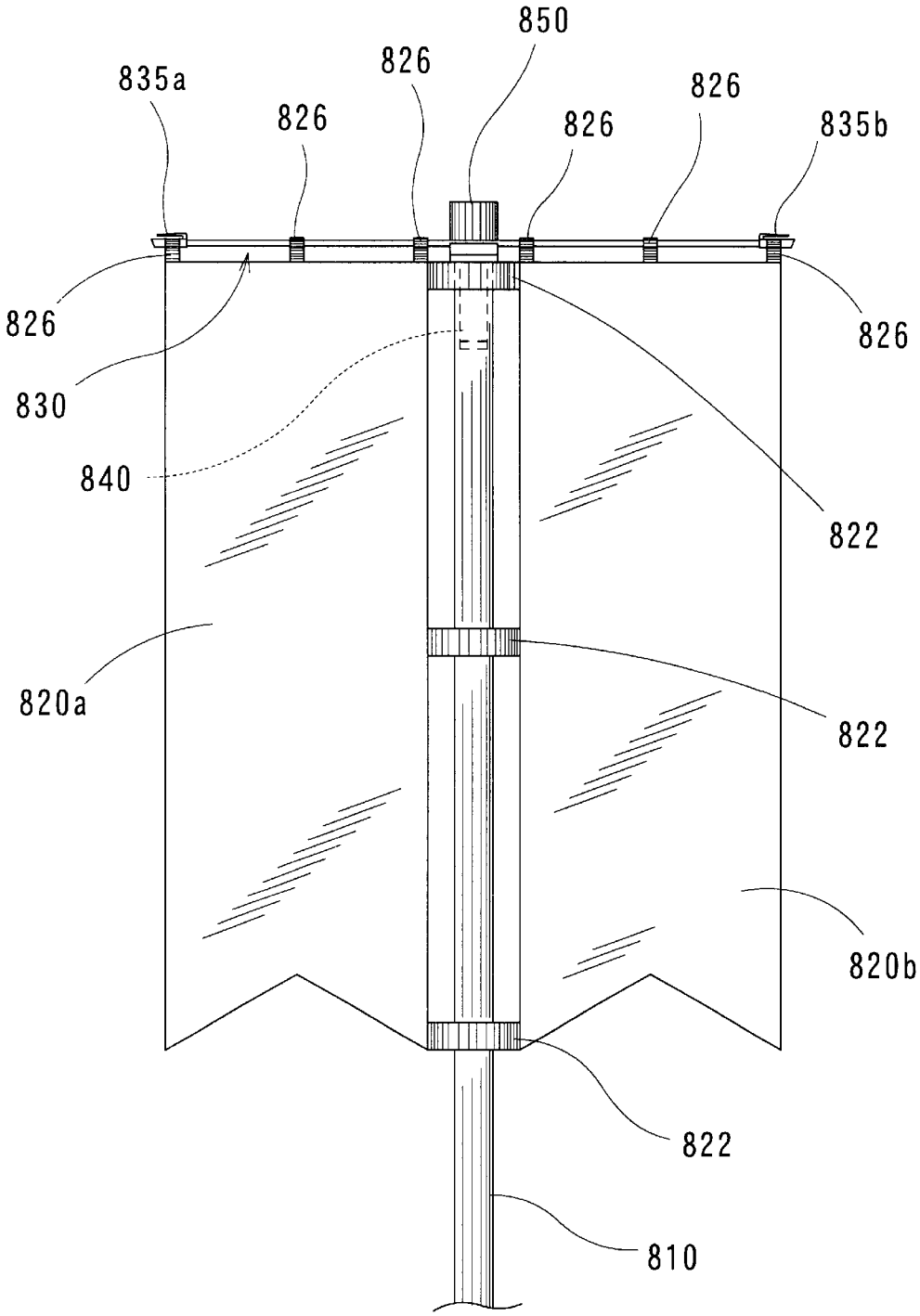
FIG. 16 shows a plan view of a known flag set.
Figure 17:
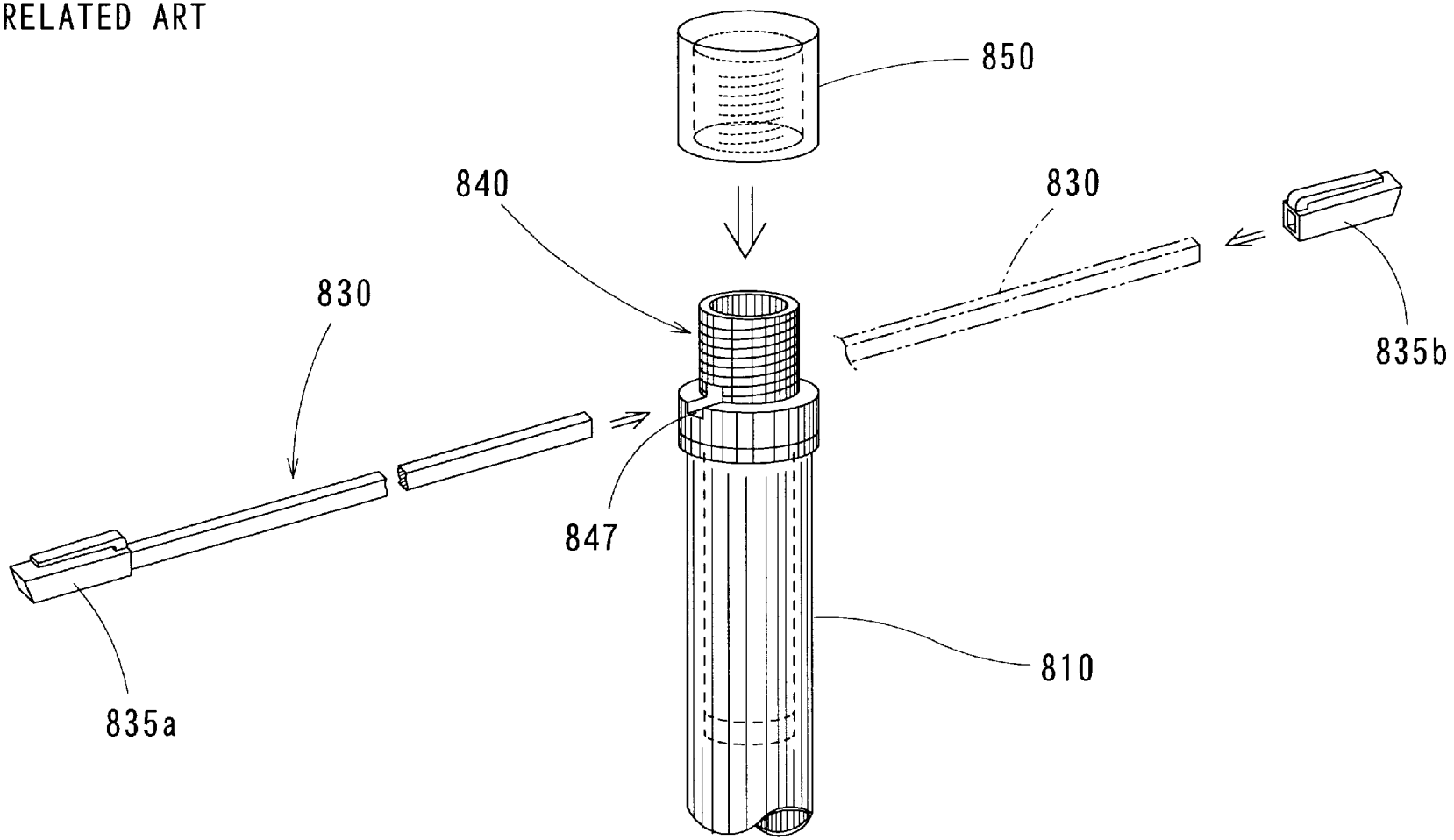
RELATED ART FIG. 17
FIG. 17 shows an oblique view of certain portions of the known flag set.

Four slits 647 may be formed in the connecting part 645. The four slits 647 may radiate outward from the center at equal angular intervals (90° interval.) Each slit extends vertically from the top of the connecting part 645, reaching the top part of the flange 644. In other words, four grooves are formed at equal angular intervals (90° interval) on the upper part of the flange located outside the connecting part 645, as shown in FIG. 13, FIG. 15A and FIG. 15B. The width of each slit 647 and the width of each groove 648 preferably conform to the width of the cross section of support rods 630 a through 630*d*, respectively. The depth of each slit 647 is made sufficiently deeper than the height of the cross section of support rods 630*a* through 630*d*, respectively. Each slit 647 and each groove 648 opens upward to allow insertion of the support rods 630*a* through 630*d* from the top.

The upper surface of the flange 644 inside the connecting part 645 may define a receiving surface 649 (corresponding to the receiving part). The height of the receiving surface 649 is preferably the same height as the bottom of grooves 648. The receiving surface 649 receives the bottom surface (bottom side) of the insertion parts 632 of the support rods 630*a* through 630*d*. Alternatively, each slit 647 may stop short of the flange 644. Further, the upper surface of the flange 644 may be made the same height as the inner and outer sides of the connecting part 645.

The fastening part 650 is preferably attached to the top of attachment part 640. The fastening part 650 may have a larger diameter than the fastening part 50 in the first embodiment, in order to conform to the larger sizes of the attachment part 640 and the connecting part 645. The fastening part 650 may include a cylindrical part 653 shaped as a cylinder with the top opening closed by a top plate 651. A female thread 652 may be formed on the inside surface of the cylindrical part 653. The female thread 652 is adapted to mate with the male thread formed on the attachment part 640.

A contacting stud 654 (corresponding to the contact part) may be disposed inside the fastening part 650, as shown in FIG. 13, FIG. 15A and FIG. 15B. The contacting stud 654 extends downward from the bottom of the top plate 651 along the center axis line of the fastening part 650. The bottom end of the contacting stud 654 is at the same height as the bottom end of the cylindrical part 653. The contacting stud 654 of this representative embodiment preferably has a larger diameter than the contacting stud 54 in the first representative embodiment. The contacting stud 654 (its bottom) will contact the upper surface of the insertion parts 632 of support rods 630*a* through 630*d*, respectively, when the flag set is assembled.

An anti-slipping surface (not shown) may be provided on the outer periphery of the cylindrical part 653. The fastening part 650 (female thread 652) is screwed onto the attachment part 640 (male thread 646).

A representative method for using this flag set will be described. The support rods 630*a* through 630*d* may be connected to the pole 10 in the following manner. First, the attachment part 640 is attached to the pole 10 as shown in FIG. 13. Then, with the fastening part 650 removed, the support rods 630*a* through 630*d* (parts near the insertion part 632) are inserted into the slits 647 and the grooves 648 of the attachment part 640. Then, the fastening part 650 is screwed on to the attachment part 640, as shown in FIG. 13, FIG. 15A and FIG. 15B. The support rods 630*a* through 630*d* are held by being squeezed together between the cylindrical part 653 (its bottom part) of the fastening part 650 and the grooves 648 (their bottoms) of the attachment part 640. Thus, the support rods 630 and the attachment part 640 (slits 647) may be attached in this manner.

In addition, the contacting stud 654 (its bottom part) of the fastening part 650 may push against the upper surfaces of the insertion parts 632 of the support rods 630 a through 630*d*, as shown in FIG. 15B. Then, the insertion parts 632 of the support rods 630*a* through 630*d* are squeezed together between the receiver surface 649 of the flange 644 and the contacting stud 654. The support rods 630*a* through 630*d* may be connected to the pole 10 in such a manner that they can rotate around the axis of the pole 10. They are also supported at a right angle with the pole 10 (in other words, in a horizontal position when the pole 10 is held vertical).

Additionally, the combined size of the insertion parts of the support rods 630*a* through 630*d* preferably conforms to the size of the inside of the connecting part 645 (receiving surface 649). Therefore, shifting of the insertion parts 632 inside the connecting part 645 can be prevented. Shifting of the support rods 630*a* through 630*d* in the horizontal direction is also prevented in this manner.

As depicted in FIG. 13 in chain lines, the flag units 620*a* through 620*d* (joint flag unit 621) may be attached to the pole 10 and the support rods 630*a* through 630*d* as follows. Before each support rod 630*a* through 630*d* is attached to the attachment part 640 (pole 10), the pole 10 is passed through the loops 622 to attach the flag units 620*a* through 620*d* (joint flag unit 621) to the pole 10. Next, each support rod 630*a* through 630*d* is passed through the loops 626 and each flag unit 620*a* through 620*d* is attached to each support rod 630*a* through 630*d*. Then, each support rod 630*a* through 630*d* is attached to the attachment part 640 (pole 10), as described above.

In addition, the loop 626, which is used to attach the flag unit(s) to the support rod(s) and is provided at the tip of each flag unit 620*a* through 620*d*, is hooked onto the hook 35 (refer to FIG. 1 and FIG. 2), after the flag units 620*a* through 620*d* (joint flag unit 621) are attached to the support rods 630*a* through 630*d*. The flag units 620*a* through 620*d* are prevented from shifting on the support rods by this arrangement. The four flag units 620*a* through 620*d* can be easily attached to the pole 10 at the same height in this flag set as well. Consequently, it gives a novel impression to the viewers.

As a variation of this embodiment, the contacting stud 654 on the fastening part 650 can be arranged so that its position relative to the fastening part can be adjusted in the axis direction (lowered or raised). For example, a screw hole may be formed at the top plate 651 of the fastening part 650 and a corresponding male thread may be formed on the contacting stud (on its outer periphery). In this case, the fastening part 650 may be attached to the attachment part 640 with the contacting stud raised somewhat relative to the fastening part 650. Then, after the fastening part 650 is re-attached, the contacting stud 654 may be lowered relative to the fastening part 650 to apply pressure to the insertion parts 632 of the support rods 630*a* through 630*d*. By this action, the support rods 630*a* through 630*d* can be maintained at a right angle against the pole 10 more reliably.

In addition, as another variation of this embodiment, the differences that exist between the second representative embodiment through the seventh representative embodiment and the first representative embodiment may be applied to this representative embodiment. In other words, three or six flag units may be used, each support rod may be bent upward and/or each support rod may be curved in a horizontal direction. Additionally, a flag set may be provided such that the number of flag units attached to the pole can be conveniently changed.

The first embodiment through the seventh embodiment of the flag set of this invention represent just a few examples of the present teachings. A multitude of variations may be made based upon the knowledge of those skilled in the art. For example, the attachment part (40, 140, . . . ) may be fixed to the pole 10 in such a manner that it cannot rotate about the axis of the pole. The structure would prevent the flag units (20*a*, 20*b*, . . . from rotating about the axis of the pole 10.

In addition, loops that are used to attach the flag unit(s) to the pole (122, 222, . . . ) may be left undivided. Instead of the loops for the pole, one end of the loops (26, 126, 226,. . . ) may be made attachable and detachable to the flag units (20*a*, 20*b*, 120*a* through 120*c*, 220*a* through 220*d*, . . .) by means of hooks or fasteners. In this case, the flag units (20*a*/20*b*, 120*a* through 120*c*, 220*a* through 220*d*, . . .) may be attached to the pole 10 first, independent of attaching the support arms (30, 130, 230, . . .) to the pole 10. Then, both items (support arms and flag units) are attached to the pole 10, and finally the support arm and the pole may be connected together.

Additionally, the loops that are used to attach the flag units to the pole (22, 122, 222, . . . ) may be divided into divided parts for the loop, and additionally one end of the loops, used to attach the flag unit to the support rod (26, 126, 226, . . .) may be made attachable and detachable to the flag units (20*a*/20*b*, 120*a* through 120*c*, 220*a* through 220*d*, . . . )

What is claimed is:

1. A flag set comprising:

a pole, a plurality of flag units disposed substantially in parallel with respect to a longitudinal axis of the pole, a support arm extending substantially perpendicularly from said pole, said support arm being substantially elongate and holding only the top edges of the plurality of flag units, an attachment part provided at the top of the pole that opens upward so that the support arm can be inserted from the top and a fastening part arranged and constructed to be attached to the top of the pole from above the support arm and above the pole, wherein the fastening part anchors the support arm to the attachment part.

2. A flag set as described in claim 1, wherein the support arm comprises at least three support rods radiating outward and each support rod holds the upper edge of each of said flag unit.

3. A flag set as described in claim 1, wherein the support arm comprises at least one curved support rod and the support rod holds the upper edge of said flag unit.

4. A flag set as described in claim 1, wherein the attachment part comprises a pair of vertical slits adapted to receive the support arm.

5. A flag set as described in claim 4, wherein the attachment part comprises at least three vertical slits, wherein each vertical slit is adapted to respectively receive one support rod.

6. A flag set as described in claim 1, wherein the support arm comprises at least two support rods, each support rod having a first end and a second end, wherein the first end is farther from the pole than the second end, wherein a hook is permanently affixed to the first end and each support rod comprises a base portion formed at the second end, wherein the respective base portions are constructed to abut each other in a complimentary manner and the base portions are received within the attachment part.

7. A flag set as described in claim 6, wherein the attachment part comprises a pair of vertical slits adapted to receive the support arm.

8. A flag set as described in claim 1, wherein the attachment part comprises at least three vertical slits, wherein each vertical slit is adapted to respectively receive one support rod.

9. A flag set as described in claim 8, wherein the support arm comprises at least two support rods, each support rod having a first end and a second end, wherein the first end is farther from the pole than the second end, wherein a hook is permanently affixed to the first end and each support rod comprises a base portion formed at the second end, wherein the respective base portions are constructed to abut each other in a complimentary manner and the base portions are received within the attachment part.

10. A flag set as described in claim 9, wherein at least one support rod is curved and a hook is permanently attached to each terminal end of the support arm.

11. A flag set as described in claim 1, wherein the attachment part comprises a pair of vertical slits adapted to receive the support arm, the one support arm is curved, a hook is permanently attached to each terminal end of the support arm, wherein each the terminal end is farther from the pole than the other end, and the hooks have a cross section that is larger than the cross section of the vertical slits.

12. A flag set comprising:

a pole, a plurality of different flag units adapted to be attached to the pole, a plurality of different support arms extending substantially perpendicularly from said pole, said plurality of different support arms being substantially elongate and adapted to hold only the upper edges of the flag units, an attachment part provided at the top of said pole that opens upward so that one or more support arms can be inserted from the top and a fastening part adapted to anchor the support arm and said attachment part, wherein the fastening part is attached to the top of said pole after either the support arm is inserted into said attachment part, wherein the support arm is selected from the plurality of different support arms and the support arm correspond to the flag unit is selected from the plurality of flag units.

13. A flag set as described in claim 12, wherein the attachment part comprises a pair of vertical slits adapted to receive the support arm.

14. A flag set as described in claim 13, wherein the attachment part comprises at least three vertical slits, wherein each vertical slit is adapted to respectively receive one support rod.

15. A flag set as described in claim 14, wherein the support arm comprises at least three support rods, each support rod having a first end and a second end, wherein the first end is farther from the pole than the second end, wherein a hook is permanently affixed to each of the first end and each support rod comprises a base portion formed at the second end, wherein the respective base portions are constructed to abut each other in a complimentary manner, the base portions are received within the attachment part and the hooks have a cross section that is greater than the cross section of the vertical slits.

16. A flag set as described in claim 14, wherein the support arm comprises four support rods, each support rod having a first end and a second end, wherein the first end is farther from the pole than the second end, wherein a hook is permanently affixed to each first end and each second end comprises a base portion, wherein the respective base portions are constructed to abut each other in a complimentary manner, the base portions are received within the attachment part and the hooks have a cross section that is greater than the cross section of the vertical slits.

17. A flag set as described in claim 16, wherein at least one support rod is curved.

18. A flag set as described in claim 12, wherein the attachment part comprises a pair of vertical slits adapted to receive the support arm, at least one support arm is curved, a hook is permanently attached to each terminal end of the support arm and the hooks have a cross section that is larger than the cross section of the vertical slits.

19. A flag set comprising:

a pole, a plurality of flag units adapted to be attached to the pole in different directions with respect to said pole, a plurality of support rods extending substantially perpendicularly from said pole, said plurality of support rods being substantially elongate, each comprising a base part and each adapted to hold only the top part of a flag unit, an attachment part provided at the top of the pole and opening upward so that the base part of the support rods can be inserted from the top, a fastening part that anchors the plurality of support rods to said attachment part, wherein the fastening part is fastened to the top of said pole after at least two support rods are inserted into said attachment part, a receiving portion provided proximally to the attachment part and formed to hold an underside of the base parts of at least two support rods and a contacting stud provided inside the fastening part, wherein the contacting stud contacts and pushes the upper part of the base of the support rods in order to hold the base parts of the support rods against the receiving portion.

20. A flag set as described in claim 19, wherein the attachment part comprises at least three vertical slits, wherein each vertical slit is adapted to respectively receive one support rod.

* * * * *